US009687709B2

(12) United States Patent
Riniti

(10) Patent No.: US 9,687,709 B2
(45) Date of Patent: Jun. 27, 2017

(54) MULTI-CONFIGURABLE BEAN BAG GAME AND METHOD OF GAME PLAY

(71) Applicant: Anton Riniti, Canyon Lake, CA (US)

(72) Inventor: Anton Riniti, Canyon Lake, CA (US)

( * ) Notice: Subject to any disclaimer, the term of this patent is extended or adjusted under 35 U.S.C. 154(b) by 0 days.

(21) Appl. No.: 15/060,419

(22) Filed: Mar. 3, 2016

(65) Prior Publication Data

US 2016/0256758 A1 Sep. 8, 2016

Related U.S. Application Data

(60) Provisional application No. 62/127,825, filed on Mar. 4, 2015.

(51) Int. Cl.

| | |
|---|---|
| ***A63B 63/00*** | (2006.01) |
| ***A63B 67/06*** | (2006.01) |
| ***A63B 63/08*** | (2006.01) |
| *A63B 71/02* | (2006.01) |
| *A63B 71/06* | (2006.01) |

(52) U.S. Cl.

CPC ..... *A63B 67/06* (2013.01); *A63B 63/08* (2013.01); *A63B 63/00* (2013.01); *A63B 2063/002* (2013.01); *A63B 2067/061* (2013.01); *A63B 2071/025* (2013.01); *A63B 2071/0694* (2013.01); *A63B 2209/08* (2013.01); *A63B 2209/10* (2013.01); *A63B 2210/50* (2013.01); *A63B 2225/09* (2013.01); *A63B 2225/093* (2013.01)

(58) Field of Classification Search

CPC ..... A63B 67/06; A63B 67/08; A63B 2210/50; A63B 63/00

USPC ..... 273/398–402

See application file for complete search history.

(56) References Cited

U.S. PATENT DOCUMENTS

| | | | | |
|---|---|---|---|---|
| 922,717 | A * | 5/1909 | Parker | A63B 67/06 273/401 |
| 4,936,590 | A * | 6/1990 | Palmer | A63B 63/08 273/285 |
| 5,320,360 | A * | 6/1994 | St. Pierre | A63F 9/0204 273/402 |
| 6,179,295 | B1 * | 1/2001 | Lanza | A63F 9/02 273/123 R |
| 7,775,525 | B2 * | 8/2010 | Staver | A63B 67/06 273/317.1 |
| 7,854,528 | B2 * | 12/2010 | Segretto | A63B 63/08 273/402 |
| 2008/0179833 | A1 * | 7/2008 | Held | A63F 9/02 273/402 |
| 2010/0058958 | A1 * | 3/2010 | Christian | A47B 3/0912 108/19 |

(Continued)

*Primary Examiner* — Mark Graham
(74) *Attorney, Agent, or Firm* — Donn K. Harms

(57) ABSTRACT

A multi-configurable bean bag tossing game is provided which features a body having bins depending into a top surface. The top surface of the body is removably engageable with any of a plurality of game slats each of which position game indicia and a plurality of slat apertures aligned with some or all of the bins in the top of the body thereby allowing users to change the game being played by changing the game slat. A transit slat is also engageable with the top of the body to form a table, and support frame is engageable with the body to form a storage cavity for the game slats, and provide both wheeled support for rolling the device along with folding legs to support the assembled device.

16 Claims, 8 Drawing Sheets

(56) References Cited

U.S. PATENT DOCUMENTS

| | | | | |
|---|---|---|---|---|
| 2014/0374992 | A1* | 12/2014 | Reile | A63B 67/06 273/402 |
| 2015/0069708 | A1* | 3/2015 | Mashburn | A63B 67/06 273/400 |
| 2015/0115532 | A1* | 4/2015 | Martinson | A63B 67/06 273/400 |

* cited by examiner

MULTI-CONFIGURABLE BEAN BAG GAME AND METHOD OF GAME PLAY

This application claims priority to U.S. Provisional Patent Application Ser. No. 62/127,825 filed on Mar. 4, 2015, which is incorporated herein in it's entirety by this reference thereto.

FIELD OF THE INVENTION

The present device relates to games of dexterity and entertainment. More particularly, the disclosed device and method relates to a portable bag throwing game which is multi-configurable to a multitude of game face slats to create games of various themes, colors, difficulties and with differing point systems, and method of play of multiple games resulting from said multi-configurations.

BACKGROUND OF THE INVENTION

An array of bag toss games currently exist in the United States and most civilized countries which employ a hand-tossed bag filled with beans or other loose media. In most bag toss style games the user plays by throwing or lofting a pliable projectile at or toward a target. Very often a bean bag or other soft spherical object is employed which must be thrown through a goal, gate or hole in a game board to earn points or prizes.

Bag toss style games have been widely used in a broad range of venues including carnivals, parties, picnics, display booths, and other gaming arenas. Such games are easily adaptable to skills of users of all ages. This can be accomplished by modifying the ratio between the size of projectile, and the goal through which it passes or fits within. Other adjustments to the skill and dexterity levels required can be accomplished by increasing or decreasing the distance at which the player must stand from the board through which the bag must be tossed to score points.

Many such target oriented game devices add complexity by tilting the target of the device at an angle. This requires the player to modify the required trajectory of the bag or tossed object to achieve a successful score. Such bag toss games typically allow for positioning of the target at only one angle limiting the ability of players to increase or decrease a games difficulty by increasing or decreasing the target angle. Also, such bag toss game devices are typically specialized to play only a single game with a specific game theme and point system. Thus, once purchased, the game is limited to a single audience, venue or event.

Additionally, in conventional bag toss games of limited scope, ongoing users playing the game may tire of replaying the same game, with the same scoring targets, and the same rules, because most of the currently available bag toss game devices are limited to certain venues and game skills.

As such there is an unmet need for a multi-function or multi-configurable tossing style game device and system, and method of game play, which is easily adaptable to differing targets, target angles, rules, and point systems, to allow players to develop and use a broad range of user skills. Such a device should also be easily configurable for themes and point schemes such that players who become bored with one configuration can change to another more challenging or entertaining configuration. Such a bag toss device and system should be provided in simpler systems which provide multiple games and rules and in modes which self-house multiple removable and replaceable target faces, with differing markings, hole sizes and placements, to thereby allow for easy reconfiguration to a variety of game structures. Additionally, such a device should include modes which have wheeled support for easy transportation as well as onboard game storage. Further, it is preferred in all modes that the game unit include adjustable folding legs to allow the user to vary the height and tilt of the game target surface to accommodate play of differing games as well as to adjust skill levels required on each, or provide a means to include a handicap for more skilled users by making the angle of play during their turn, harder to compete.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

OBJECTS OF THE INVENTION

It is an object of the present invention to provide a multifunction bag toss style game capable of being employed for a variety of game styles and themes.

It is an additional object for the device herein to include means for secure storage of the multiple engageable game boards during play or during transportation, and for storage and transport of items of the users' choosing related or unrelated to the device or method.

It is a another object of the present invention for the device and system to include a plurality of individually extendable and folding legs to support the target game board, to allow for game play at various heights and tilts, and easy storage and transportation.

Yet another object of the present invention is to provide a method for the play of a plurality games in connection with the device.

These and other objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

SUMMARY OF THE INVENTION

In accordance with the purposes of the present invention, as embodied and broadly described herein, the present invention provides a bag toss system which is configurable as a multi-functional bag throwing game which is configurable with adjustable legs, wheels, or both if a wheeled support is operatively engaged.

The device includes a main body, which is configured on a first side to removably engage a plurality of game slats. In a simple mode of the device, the slats can be stored adjacent the main body. In a wheeled mode of the device, a wheeled support is engageable to the lower surface of the main body and includes a storage compartment where the slats can be stored onboard the main body. In either mode, the slats are configured to be interchangeable with each adapted to register in engagement with bins located on the body. The apertures formed in each slat, when engaged to the main body, are positioned in line with a respective recess or cavity in the main body. The interchangeable slats with game indicia thereon, and apertures positioned appropriately to play the game, configure the device allow for the play of a plurality of different games, depending on the indicia and aperture locations in each of the individual slats. There is no limit to the number of slats nor the number of different games the respective slats can be configured to provide play to the user. As such, the device can continually be upgraded by engaging new slats which allow for the play of different games with different rules.

In the preferred mode of the device, a main body of the device contains a plurality of differing or equally sized round or rectangular bins or recesses depending into an upper surface. Each of the recesses are sized with a length of width or diameter of between 2 and 10 inches. These individual recesses or bins are positioned to register in alignment with one or a plurality of apertures formed in each respective engageable slat.

Currently, a favored mode of the device positions the recesses or bins in an array featuring three rows and five columns. This allows for the slats to include apertures equal to or less than the total number of recesses or bins and to adjust both the game being played and how hard the game is to play.

However, other configurations can also be employed such as four rows and three columns or other configurations adapted to position the recesses or bins, registered in position, adjacent and in-line with an aperture being used to play a game which is formed in the game slat. In alternative modes of the device, the recesses defining the bins, can be shaped in any geometric cylinder or cubical shape.

Games employing the device and system herein, in one preferred mode, allow individual players attempt to throw one or more projectiles, such as bags containing beans or pellets or similar loose material, through one or more of the apertures formed in a given slat. The tossed projectile scores points, when it passes through an aperture and into a recess or bin aligned therewith and depending into an upper surface of the body of the device.

Removable game slats with different coloring, markings and aperture positioning and shapes are provided which allow for differing games to be played of differing complexity and skill. Employing any of the individual slats, allows the user to employ the device to play one of the various tossing type games defined by the indicia on the individual slats and number and location and shape of the apertures therein. Thus, the players are provided with a broad range of point schemes, strategies and themes depending on the indicia and aperture number, geometry and positioning in each respective slat.

The preferred game slat configurations contain an array of geometric apertures in various patterns and sizes and shapes, which may totally or partially block communication of the tossed object or bag, with the corresponding recess defining the bin located in the body of the compartment in-line and below the respective aperture. An infinite number of slats can be configured and can employ any arrangement, number or geometric-shape of the apertures and indicia. Using this slat and aperture alignment with bins, a near infinite number of feasible games can be provided.

Additionally preferred in the device, a transit slat with no apertures therein can be provided. This transit slat may be inserted into the slat engagement slot positioned on the upper surface of the body of the device to protect the bins and interior compartment of the body during transportation or storage. However, the transit slat also permits users to employ the device for the transport and/or storage of items of users' choice related or unrelated to the device or method of game play. Further, the device with the transit slat engaged may also function as a table for eating, crafts, or other tasks which has been found to be especially handy when the device is not being employed as a game, but occupying space in room.

Still further, the device may have one or more of a plurality of transit slats which may be free of indicia or which may include indicia such as a rendering of a board game, including classic board games such as chess, checkers, and backgammon, permitting the device to be employed as a traditional gaming table when a transit slat with such gaming indicia is engaged, and the device configured as a table.

The body on one side surface adjacent the interior compartment, which operates as an upper surface during use, includes a slat securement or connection. Currently a favored connection of the slat is a formed slot or channel to constrain the slat upon or adjacent the top surface of body of the body during use. The slat engagement shown as an elongated slot formed on opposing sides of the top surface of the body, is configured to slidably engage any of the plurality of slats, and position each of the apertures present, registered in position adjacent and aligned with a respective recess or bins depending into the top surface of the body.

The slat securement employed can additionally be configured to prevent unintentional slat ejection using a slat fastener such as one or a combination from a group of fasteners including snaps, clips, magnets, pins, straps, flexures, hook and loop fasteners, screws, latches, or any additional means for temporary securement that renders the slat secure in the engagement slot, but easily removable.

In a simple mode of the device, the body includes the channel or slot for engagement of any of the plurality of slats on a first or top surface. On an opposite second or lower surface, openings are provided for the engagement of a plurality of legs which are each preferably adjustable in length. In this simple mode, the plurality of slats engageable with the body can be stored adjacent the body and engaged and changed as needed.

In a mode of the device providing additional utility, a wheeled support member can be engaged to the second or lower side of the body. This wheeled support includes at least one and preferably a pair of wheels which project from a side edge when the support is engaged with the lower or second side of the body. So engaged, the support allows the user to roll the body during transport on the projecting wheel or wheels. Further, engagement of the support member to the second or lower surface of the body, forms a slat storage area in between the engaged support member and the lower or second surface of the body. In this preferred mode of the device the storage area is formed as a cavity between the lower side of the body and the support member which is accessible through a slot. The storage cavity is adapted to hold slats which are not currently in use during game play or during device transportation. The slats are insertable and removable from the storage cavity through the access slot.

A means for securing the slats within the slat storage area, to prevent accidental ejection through the access slot, includes in one preferred mode of the device, a snap and snap strap. However, the securement for the slat in storage can additionally be composed of one or a combination of any easily removable securement components which are positionable to block a sliding of slats through the access slot. Such fasteners include but should not be limited to one or a combination of securement components from a group including looped straps, elastic bands, hooks, clasps, hasps, hook and loop fasteners, thumb screws, and magnets.

Although the device can be employed while the main body lays flat and supported on the floor, it is preferred that the body be elevated to elevate the slat being employed for the chosen game. A plurality of extendable or telescopic legs are currently employed to elevate the body which are either engaged to the support member, or directly into the noted openings formed in the second or lower surface of the main body.

When engaged with the support member, each leg is connected to the body forming the interior compartment in a pivoting connection such as with a hinge. Tilting the legs to different angles provides a means to raise and tilt the body of the device as does changing the length of the legs when telescopically configured. It should be noted these folding and tilting legs can also be employed with the more simple mode of the device, instead of the simple legs shown in FIGS. 1 and 2.

Whether folding or fixed, each telescoping leg is composed of at least two cylindrical tubular components, an inner leg, whose proximal end rotates about the hinge, and an outer leg component, whose proximal end slides over the inner leg. A distal end of the outer leg component includes a foot pad for stability during play.

In the preferred mode of the device, the telescoping leg components include a locking component which may be removably engaged to fix the adjusted length of the leg. While not limiting one locking component shown is a set of spring loaded pins which engage through apertures of the sliding portion of the leg, as a means for fixing length adjustment. This allows the user to select and lock the leg length and resulting orientation of the device. Other leg length securing fasteners may be substituted or added including, but not limited to, one or a combination of fasteners including spring pins, pins, fasteners, lead screws, clips, or a twist-lock configuration where a twisting of the two leg portions in one direction locks them.

For storage and transportation of the device, each leg may be fully compressed, and in the mode employing folding legs, the legs may fold flat against or adjacent the second or lower surface of the body. This allows the device to save space and bulk.

To ensure that the legs remain in the folded or erect positions during transportation or game play, respectively, the hinge or body may additionally include a locking mechanism to hold the distal ends of the legs adjacent the body. Such locking mechanisms may include one or a combination of locking components from a group including spring pins, pins, fasteners, magnets, clasps, hook and loop fasteners, bands or flexures.

The compartment housing the recesses defining the bins, between two side surface areas, and aligned with apertures in the slats, should be preferably made of a durable plastic such as polypropylene, polyethylene, or other polymeric material, but can alternatively be formed of one or a combination of body materials from a group including resins, plastics, woods, metals, carbon fiber and fiberglass.

The legs for supporting the body of the device should be preferably constructed of a lightweight durable metal such as aluminum, but can alternatively be made of any combination of rigid durable material including but not limited to, woods, plastics, fiberglass, carbon fiber, or other metals.

Foot pads can be positioned at the distal end of each leg. These foot pads should be made of any durable rubber or polymer that can maintain sufficient friction against the ground to prevent device tipping or sliding.

The body of the device in one mode includes hooks or other means for permanent attachment, or removable attachment, of straps or cords composed of any number or a combination of any number of materials such as fabric, plastic, metal, and/or rubber to permit connection or attachment of additional items to the device to permit easy transportation of said items when transported with the device.

The body of the device in one mode includes one or more handles or straps positioned on one or more sides of the body of the device which are composed of any number of materials or combinations of materials such as fabric, plastic, and/or wood employed for positioning and transporting the device. It is preferred a handle or strap be positioned in the center of at least one side of the device, but the device may have one or more handles positioned on one or more sides of the body of the device centered thereon or placed in an alternate position on the body of the device. Said handles or straps may be of a fixed nature or may be telescoping in nature. In one mode, the device would include one telescoping handle centered on the side of the body of the device opposite the device side containing wheels. This telescoping handle may be raised or lowered by the user to allow the user to adjust the length of the telescoping component for ease in transporting the device when the device is positioned for engagement of the wheels of the device with the ground during transportation of the device.

Examples of the method for the play of the plurality of games defined by the slats engaged with the device are provided and set forth in more detail below in the detailed description of the device and method herein. However, those skilled in the art will realize that it is the sizing and positioning and shape and number of apertures formed in the slats which enable a multitude of different games to be played and therefore other games can be employed with the device herein which are not described.

With respect to the above description, before explaining at least one preferred embodiment of the herein disclosed invention in detail, it is to be understood that the invention is not limited in its application to the details of construction and to the arrangement of the components in the following description or illustrated in the drawings. The device herein described and disclosed in the various modes and combinations is also capable of other embodiments and of being practiced and carried out in various ways which will be obvious to those skilled in the art. Any such alternative configuration as would occur to those skilled in the art is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other tossing games and systems for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

The accompanying drawings, which are incorporated herein and form a part of the specification, illustrate some, but not the only nor exclusive, examples of embodiments and/or features of the disclosed device, and some but not all of the method of play which may be employed with the device and system. It is intended that the embodiments and figures disclosed herein are to be considered illustrative of the invention herein, rather than limiting in any fashion.

In the drawings:

FIG. 1 depicts a perspective view of one mode of the device herein wherein the body of the device is positioned in a playing configuration with a game slat in a playing position, removably engaged to cover the bins depending into the top surface, and showing support legs extended.

FIG. 2 displays a perspective view of the device as in FIG. 1, but with the game slat removed from the playing position on the top surface, and with wheels engaged to one end of the body which is supported in a raised configuration where the legs have been extended.

FIG. 3 depicts a perspective view of the device in all modes where the playing slat may be engaged or disengaged from the side of the body, and also shown is an engaged support member shown in FIG. 3*c*, having wheels and foldable legs.

FIG. 3*a* shows a simpler mode of the device of FIG. 3, wherein legs are engaged at or adjacent four corners of the body of the device.

FIG. 3*b* shows a perspective view of the second or bottom side of the device as in 3*a* showing the legs engaged at four corner positions, and the engagement area formed on the second or lower side of the body adapted to engage the support member of FIG. 3*c*.

FIG. 3*c* depicts an engageable support member having wheels on one end which is adapted to engage with the second or lower side of the body such as in FIG. 3*b* where the legs are removed, and wherein a storage area for slats is formed.

FIG. 4 displays a lower perspective view of the second or lower side of the body of the device with the support member such as in FIG. 3*c* engaged, and with the slat disengaged and insertable for storage through the slot formed on the side of the body.

FIGS. 8-20 displays a top overhead view of a plurality of differing game slats with differing aperture positions and configurations, which are employable with the body of the device and which could be included in a kit of game slats.

Figure 21:
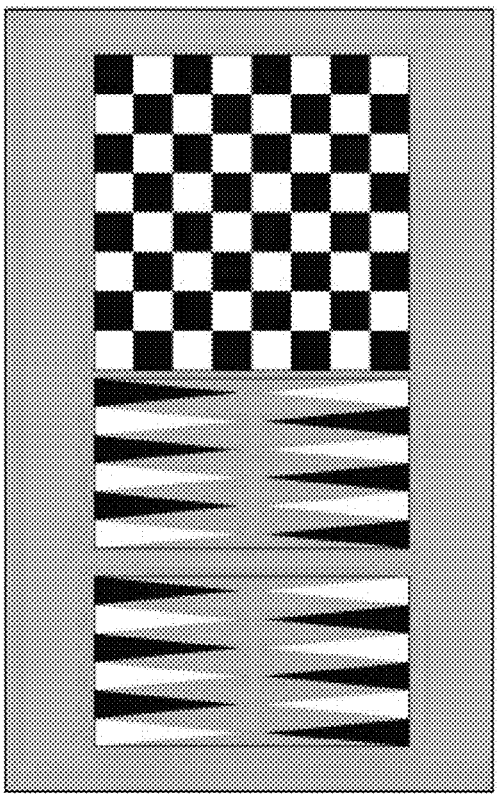

FIG. 21 displays a top overhead view of slats with game board having game indicia thereon, and which contains no apertures.

DETAILED DESCRIPTION OF THE INVENTION

Figure 1:
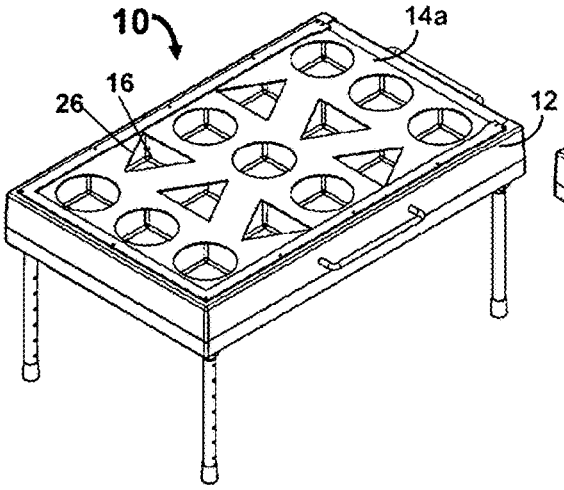

Now referring to the drawings in FIGS. 1-21, wherein similar components are identified by like reference numerals. There is seen in FIG. 1 a simple mode of the device 10 configured as a bag tossing game which employs a planar engageable slat 14 having apertures 26 positioned therein in positions, shapes, and number, and which determine the play of the game determined by the slat 14. As shown the game slat 14 is removably engaged in a playing position, covering the bins in the top surface of the device. In this simple mode, the utility of an infinite number of engageable slats 14 is available, and the body 12 has a plurality of legs engaged to rotate within recesses in a lower surface such as shown in FIG. 3*b*. The device 10 as in FIG. 1, can also include wheels 17 which allow the device 10 to be rolled with wheeled support for ease of movement. The wheels 17 are preferably wide in dimension such as 3-5 inches in width as experimenting has shown that such wider wheels provide smoother rolling over multiple soft and hard surfaces and resulting better portability.

As shown in all modes the device 10 includes a body 12, which can accommodate engagement of any one of a plurality of differing slats 14 or different game slats 14*a* depending on the play intent of the user. The slats 14 may be provided in a kit which can include any or all of the plurality of game slats shown in FIG. 8-21 or other game slats adapted for sliding engagement into the body 12 such that the apertures 26 are registered in position as noted herein.

Figure 3:
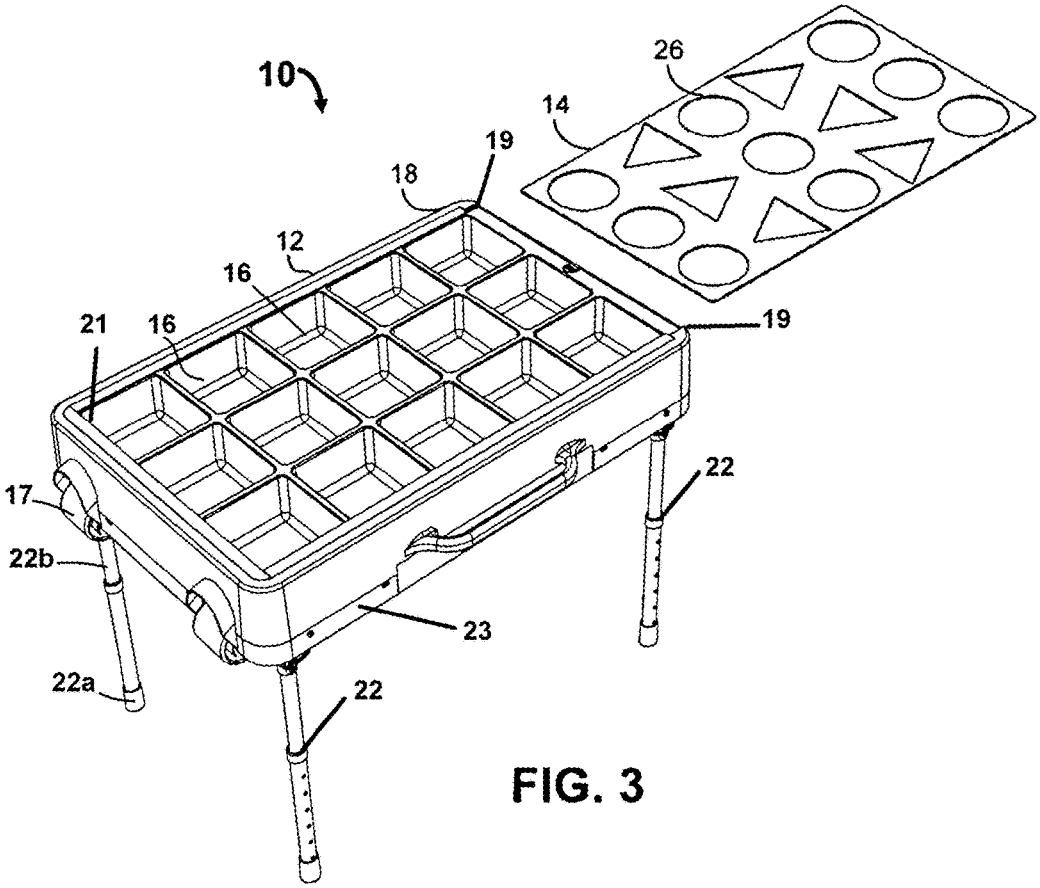
Figure 3A:
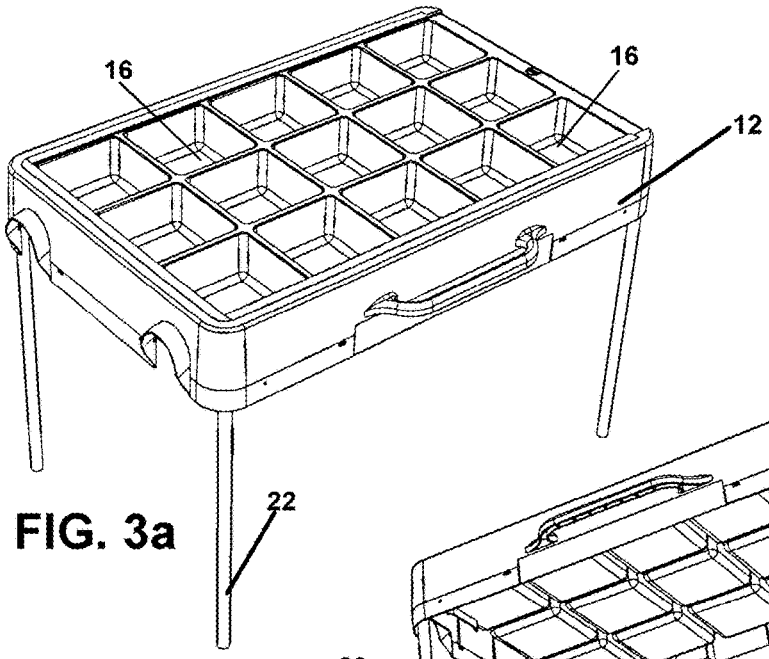

In another preferred mode of the device 10, as seen in FIG. 3, the body 12 contains a plurality of rows and columns of substantially equally sized rectangular or other shaped bins 16 or recesses. The bins 16 are adapted for catching the tossed bag or object which successfully communicates through overhead apertures 26 communicating through the slats 14. Recesses or bins 16 in a current preferred mode of the device 10 if square or rectangular have length and width between two to ten inches and if round the diameter is also between two and ten inches in range. A favored positioning of the bins 16 defined by the recesses depending into the first or top surface of the body 12 is an array of 3 rows and 5 columns. However, it should be noted that in alternative modes of the device 10, the bins 16 can be shaped in any geometric cylinder or cubical shape so long as they are sufficient in size to house the tossed bag or a plurality thereof, and the number may be changed to accommodate the game and slat 14 engaged.

Figure 2:
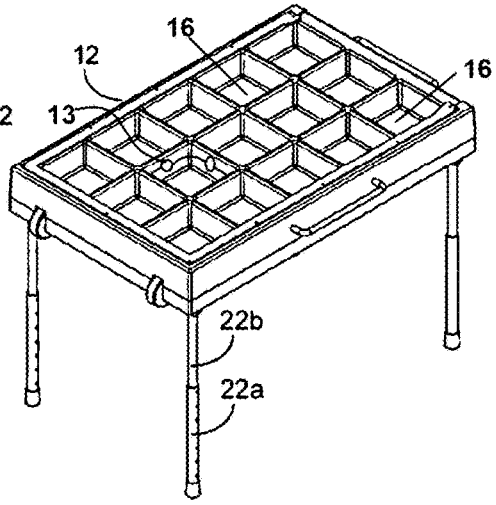
Figure 3B:
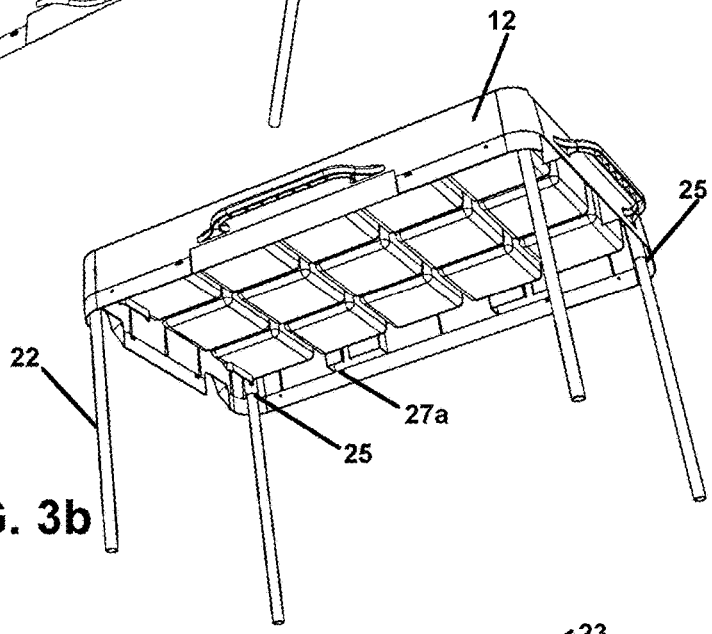

As shown in FIG. 2, where the game slat 14 has been disengaged from the game position covering the bins 16, light emitters, such as by LED illumination, can be positioned within one or a plurality of slots 16 either permanently or removably using the shown LED ring 13, in FIG. 2, or lighting may be placed upon the perimeter of the top surface of the body 12 to surround the perimeter of an engaged slat 14 to enhance viewing and play. Further, light emitters such as the LED ring 13 or other illumination components may be positioned within bins 16 within the body 12 to illuminate the bins 16, and/or to provide a visually discernable signal to the player such as blinking when a thrown bag or ball falls into a particular bin 16, or a color change where landing a bag in the colored bin 16, will increase the score while the bin 16 is illuminated in a particular color. Power for the lighting components would be one or a combination of power from the grid using a plug, or power from an onboard battery which may be recharged using the grid connection or for instance a solar panel. Further, illumination components such as LEDs can be included in the bags or balls which are employed for tossing to play the game such as blinking or simple glowing. These illuminating components can be activated by a switching component such as a motion sensor or accelerometer to illuminate when handled, moved, or tossed.

Play of the game provided the device 10 herein, in a preferred mode, occurs when players attempt to throw or toss one or more projectiles, such as a bean bag or similar pliable object. Pliable tossing components are preferred because they are not prone to bouncing, either off the slat 14 or back through one or more of the apertures 26 formed in the slats 14, such that the tossed object communicates through the aperture 26 and remains in a bin 16 in registered positioning relative thereto.

Removable game slats 14 adapted to engage with the top surface of the body 12, with different coloring, markings, indicia, and aperture 26 configurations and shapes allow the user to employ the device 10 to play a plurality of tossing type games. The changed aperture 26 configuration as well as employed indicia allow for the provision of a kit of game slats 14 having a broad range of point schemes, strategies and themes to each slat 14 in the kit, which can be depicted in the indicia on the slat 14 surface.

Figure 6:
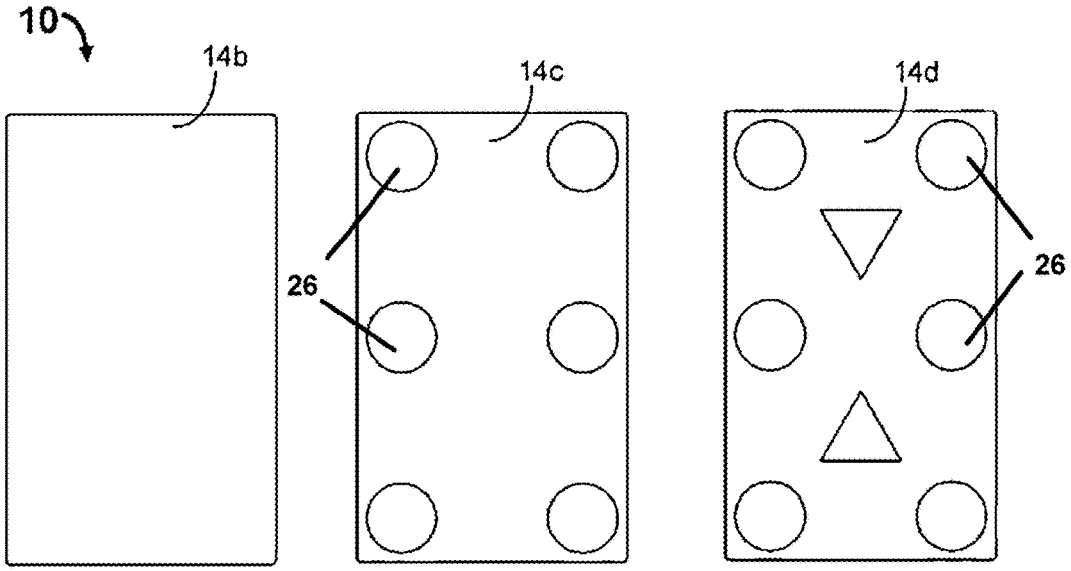
FIG. 6 depicts a top overhead views of a kit featuring a plurality of game slats in differing game configurations as well as a transit slat.

FIGS. 3 and 6, depict two preferred game slat 14 configurations which contain an array of geometric apertures 26 in various patterns, which totally or partially block communication with a corresponding bin 16 below situated in a cavity of the body. However, the slats 14 can employ any arrangement of geometric or organically shaped apertures 26 which are in registered positions relative to bins 16, to create a near infinite possibility of feasible game structures.

Also preferably provided is a transit slat 14*b* which includes no apertures 26 therein. The transit slat 14*b* can be engaged with the body 12 of the device 10 to protect the bins 16 and the body 12 during transportation. The transit slat 14*b* once engaged, also configures the device 10 to be employable as a table, which can be employed for playing other games thereon, eating, crafting, or other table uses and wheels 17 on the device 10 allow for easy transport.

This ability to be configured and function as a table is especially preferred in that it allows the device 10 to be taken to various venues where a table might also be taken, and function as such and eliminate the need to bring a table. Further, when the device 10 is occupying space in a room of a home or the like, it allows users to play other games, eat, do puzzles, and perform other tasks where a table might be required, and thus eliminates the need for a table where the device 10 is located. This function makes the device 10 much more useful for example in a child's room where there is little space for a table, or in a family room where space may be tight and the device 10 may be used and remain due to its dual function.

Shown in FIG. 3, the body 12 preferably includes a slat securement 18, which engages the slat 14 with the apertures 26 in registered positioning adjacent respective bins 16 during use. The securement 18 depicted currently is formed as two channels 19 on opposing sides of the top of the body 12, to engage at least two side edges of the slat 14 upon one side of the body 12 of the device 10 during use. The channel 19 formed on at least two opposing sides of the top surface of the body 12 allows the user to slide the slat 14 into the channels 19 on both sides until a leading end of the slat 14 meets a stop 21 formed on the opposite side of the body 12. This engagement holds the slat 14 securely to the top surface of the body 12 and with the apertures 26 registered with the underlying bins 16.

The slat securement 18 should additionally prevent unintentional slat 14 ejection from the channels 19 at a first end of the body 12. Such a securement 18 may include one or a combination of fasteners from a group including snaps, clips, magnets, pins, straps, flexures, hook and loop fasteners, screws or any additional method of temporary securement that is easily removable.

Figure 3C:
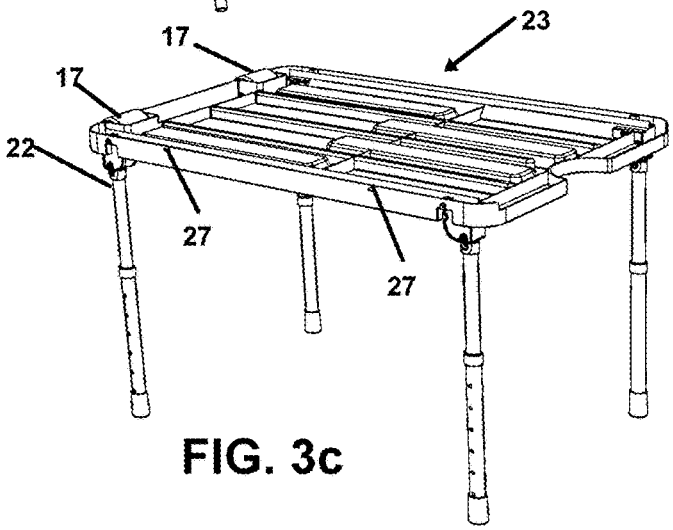
Figure 4:
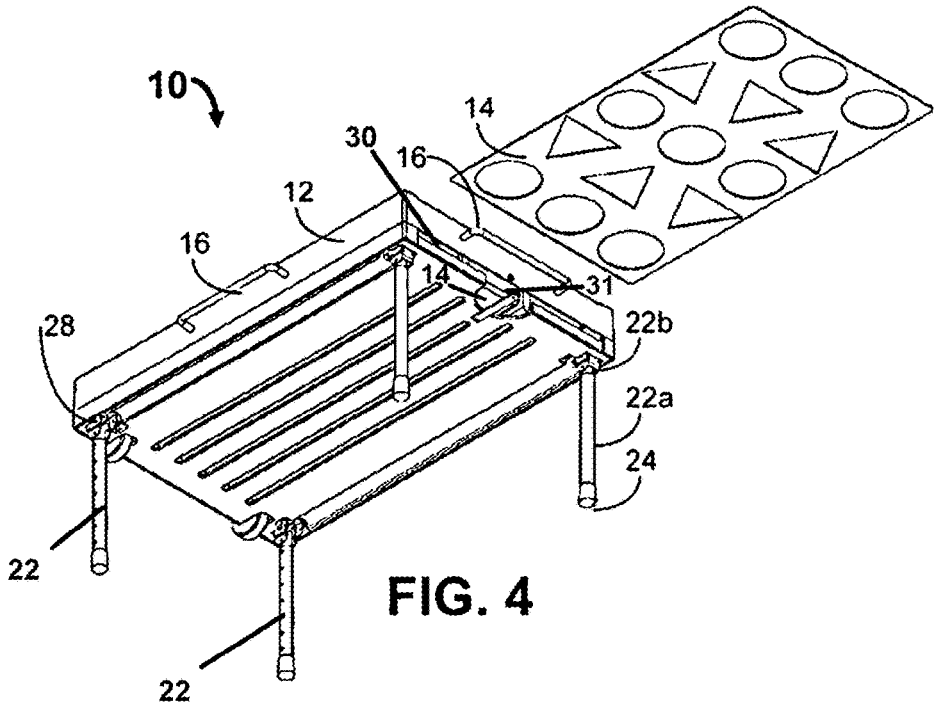

Additionally shown in FIG. 3 is the engaged support frame 23 depicted in FIG. 3*c*, which may be removably engageable with the bottom surface of the body 12, such as in 3*b* and in exploded view in FIGS. 3*b* and 3*c*. As shown in this mode, the support frame 23 includes a pair of wheels 17 and includes four folding and telescopic legs 22 which are described below. This removably engageable support frame 23 can be an option which can be provided to engage the body 12 of the simpler mode of the device 10 such as in FIGS. 3*a* and 3*b* or FIG. 1 or 2, and a manner shown in FIGS. 4-5.

This engageable support frame 23, as shown in FIG. 3*c*, is adapted to engage to the bottom surface of the body 12 such as FIG. 3*b* which is shown with simple legs 22 in the simpler mode. The support frame 23 can be provided with the body 12 already assembled in one mode or as an option in another mode of the device 10 which just has simple legs 22. If not provided with the support frame 23 already engaged, which is the preferred mode of the device herein since it includes a formed storage compartment 30, engaging the support frame 23 would simply require removing the simple legs 22 from the engagement in sockets 25 on the lower surface of the body 12, and then engaging the wheeled support frame 23. Engagement can by mating fasteners 27 formed on both the support frame 23 and bottom of the body 12. Any type of mating fasteners are employable such as the projecting flexible pins 27 on the support frame 23, which engage into mating recesses 27*a* on the bottom of the body 12. Pushing on the flexible pins 27 to disengage them from the recesses 27*a* allows the user to disengage the support frame 23 where they wish to use the body 12 on top of a table or with simple legs 22 and has shown in experimentation to be an option that gives this mode of the device 10 more utility since the user can configure it the way they want and just use the body 12, or re-engage the support frame 23 with wheels and formed compartment 30 in cases where the device 10 is used in a more portable fashion. As such, a removably engageable support frame 23 with releasable mating fasteners, such as those noted above, is the preferred configuration to provide users offering them the most utility and ease of transport and potential for multiple positions of use.

As noted, once this fastened engagement with the wheeled support frame 23 is accomplished, a slat storage compartment 30 is formed by an area between the bottom of the body 12 and a top of the support frame 23. The storage compartment 30 is dimensioned to be configured to hold slats 14 which are not currently used during game play of device 10, during transportation wherein the slats may be slid into and out of the storage cavity 30 through an opening 31 (FIG. 4) formed in one side of the engaged body 12 and support frame 23.

Figure 5:
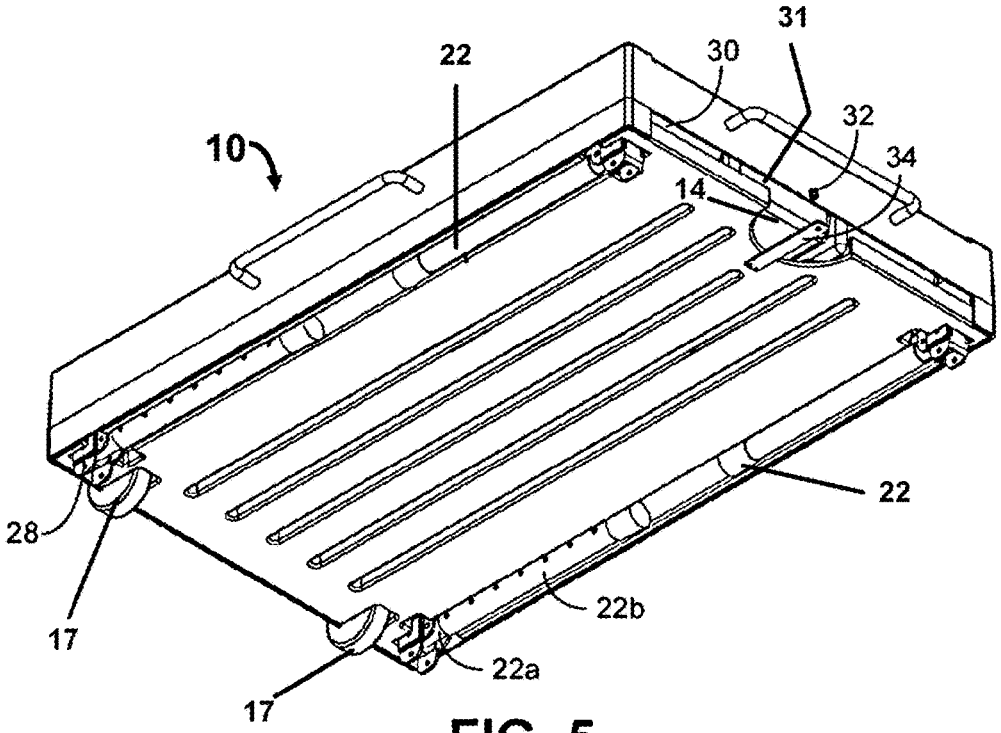
FIG. 5 depicts a lower perspective view of the device as in FIG. 2 or FIG. 4, shown in its stored configuration with legs collapsed and pivoted to a position adjacent the body.

A means to secure the slats 14 within the slat storage compartment 30 to prevent accidental spillage, is shown in one preferred mode of the device 10 in FIG. 5, as a snap 32 and snap strap 34 which will cover the opening 31 and prevent unintended exiting of the slats 14. However, other restraints can be composed of one or a combination of any easily removable securing components from a group of securing components including but not limited to, looped straps, elastic bands, hooks, clasps, hasps, hook and loop fasteners, thumb screws or magnets.

Although the device 10 can be employed while the body 12 lays flat supported on the floor, a plurality of three or more extendable legs 22, each of which are connected to the body by a hinge 28, are preferably employed to raise and tilt the body 12 of the device 10. These telescoping legs are shown in a number of the figures such as in FIG. 5, where they also are engaged to fold against the bottom of either the body 12 or as shown, into recesses 35 formed in the bottom of the support frame 23.

Each telescoping leg 22 is composed of two tubular components including an inner leg 22*a*, whose proximal end as shown rotates about the hinge 28, and an outer leg component 22*b*, whose proximal end slides over the inner leg 22*a*, and whose distal end contains a foot pad 24 for stability during play.

In preferred modes of the device 10, the telescoping leg 22 components contain a set of spring pins which engage apertures as a means for length adjustment, to allow the user to select and lock the orientation of the device 10. Although one or a combination of the other leg securing fasteners may be substituted or added including but not limited to: spring pins, pins, fasteners, lead screws, clips.

For storage and transportation of the device 10, each leg 22 should be fully compressed to save space and bulk. To ensure that the legs 22 remain in the folded or erect positions during transportation or game play, respectively, the hinge 28 or body 12 of the device should additionally contain a leg position locking mechanism including but not limited to one or a combination of spring pins, pins, fasteners, magnets, clasps, hook and loop fasteners, bands or flexures.

The body 12, and slats 14 should be preferably made of a durable plastic such as polypropylene, but can alternatively be made of one or a combination of resins, plastics, woods, metals, or fiberglass.

The legs 22 supporting all modes of the body 12 of the device should be preferably constructed of a lightweight durable metal such as aluminum, but can alternatively be made of any combination of rigid durable material including but not limited to, woods, plastics, fiberglass, carbon fiber, or metals. Additionally, a pad 24 engaged to the distal ends of the legs should be made of any durable rubber or polymer that can maintain sufficient friction against the ground to prevent device 10 tipping or sliding.

Figure 7:
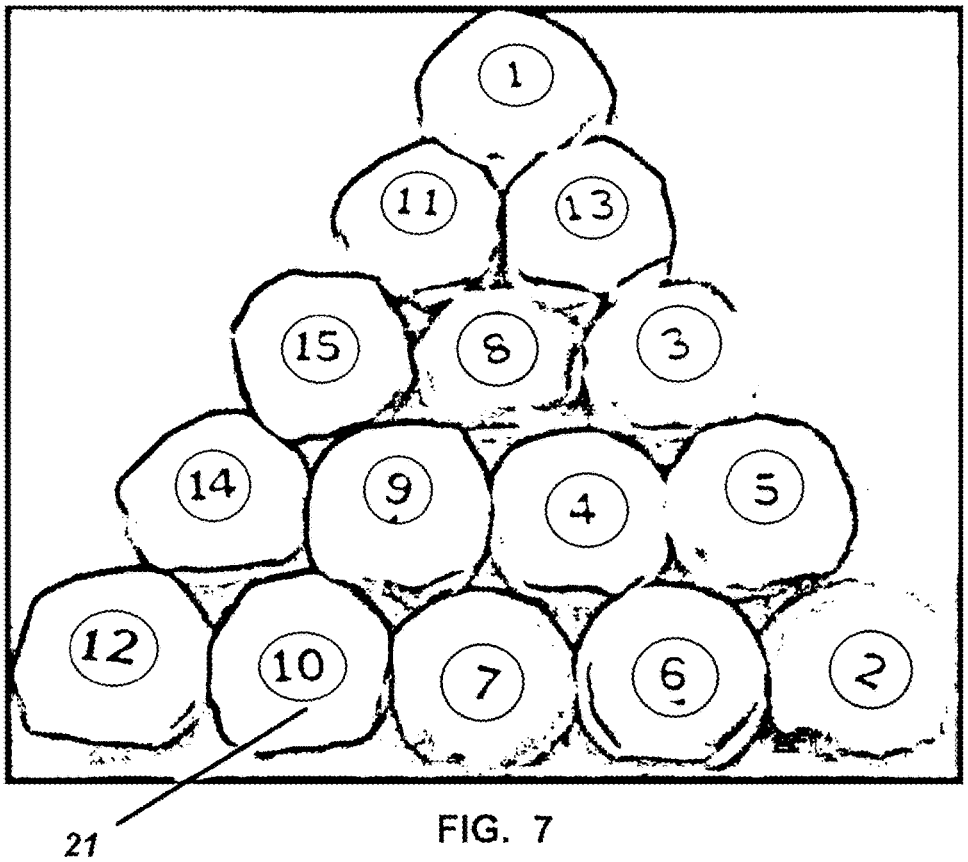
FIG. 7 shows an exemplar of a mode of the bag or balls that might be employed in one mode showing indicia on the bags or balls representative of billiard balls.

In FIG. 7 is depicted one mode of the pliable bag formed as pliable balls 21 which may be employed for tossing in the game herein. As depicted indicia is posited on the surfaces of the bags or balls 21 rendering them to appear as billiard balls. As noted the balls 21 are preferably filled with pellets rendering them similar to bean bags. Of course any indicia may be placed on the bags or balls 21 used herein, which can be employed singularly or in combination with indicia on the slats 14 to play a game. For instance the balls 21 and slats con be configured to play checkers, chess, backgammon, pool, or any other game where the slat 14 and/or bags or balls 21 are configured to play such a rendition of a game with the device 10 herein. Those skilled in the art will realize that hundreds or thousands of slats 14 can be formed with varying apertures and indicia thereon, as wells as bags or balls 21, to play an infinite number of games when the appropriate slat 14 is engaged to the device 10 and the appropriate set of bags or balls 21 are used in combination therewith.

Figure 8:
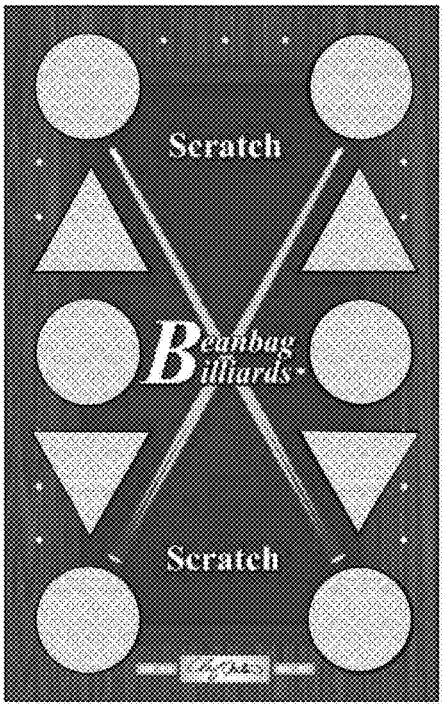

FIG. 8 depicts one possible configuration of a board slat with aperture positions and configurations suitable for use with the following modes of the method of play:

In one mode of the method of play two or more players place the board on the ground and stand six feet away from the edge of the board. Players then choose the order of players by blindly choosing a ball playing in order from the player with the lowest numbered ball to the player with the highest numbered ball. Based on the determined order of play, each player attempts to toss his ball into one of the six pockets. It does not matter which pocket the ball ends up in. A player continues tossing until he misses, scratches, or runs the table. Any balls which land on the table and do not go into a hole remain on the table and are in play. The player on the opposing team now tosses until he misses, scratches, or runs the table. After all of a players balls have been legally pocketed, that player then tosses the 8-ball. When tossing the 8-ball, the player must call the pocket the 8-ball is going into. A player whose ball goes into the "scratch hole" loses his turn and must remove one pocketed ball from his hole. If no balls have been pocketed, there is no further penalty. If a player knocks his opponent's ball into the "scratch hole," the opponent reclaims his ball and tosses the ball again. The game ends when either one player legally pockets all of his balls in the pockets and then legally pockets the 8-ball, one player scratches while pocketing the 8-ball (going off the table is not a scratch), or one player pockets the 8-ball in the wrong pocket.

In another mode of the method of play, the game is played following the forgoing rules, however, each player must call the pocket their ball is going into. If the ball is pocketed in an incorrect pocket, he must remove the ball from the pocket and lose his turn. Alternatively, in another mode of the method of play, the game is played following the foregoing rules except whichever pocket the player's last pocketed ball goes into is the only pocket the 8-ball can be legally pocketed by the player. If the 8-ball is to be pocketed into a different pocket, the game is over and the other player wins.

In another mode of the method of play two or more players place the board on the ground and stand six feet away from the edge of the board. Players then choose the order of players by blindly choosing a ball playing in order from the player with the lowest numbered ball to the player with the highest numbered ball. Players place the 1-9 balls in a bag. The 10-15 balls are not needed. Based on the order of play determined, players reach into the bag and draw a ball.

When it is a player's turn to draw, the player wants to draw either the 9-ball or the lowest numbered ball in the bag. If the player draws the lowest numbered ball left in the bag, he can toss the bag and attempt to pocket it in one of the six pockets on the table. If the player pockets the ball, he then draws any ball from the bag and continues the run. As long as the player continues to pocket balls, he keeps playing. If the players misses a pocket, the ball remains where it lies, and the player's turn is over.

If a player does not draw the lowest ball in the bag, the player tosses the ball and attempts to make it in the pocket. If the player does not pocket the ball, the ball stays where it lies. If the player pockets the ball, he gets to return the ball to the bag. Whether the player makes it or not, his turn is then over. If the player draws the 9-ball, the player can end the game by pocketing the 9-ball in one of the six pockets. If the player misses the pocket, the 9-ball gets returned to the bag.

Any balls which land on the table and do not go into a hole remain on the table and are in play. If a player accidentally tosses a ball into the "scratch hole," the player loses his turn. The next player then gets "ball in hand" which means he may draw any ball from the bag and treat it like it is the lowest numbered ball. The game ends when a player legally pockets the 9-ball.

In another mode of the method of play, the game is played following the forgoing rules with the following exceptions. If the player draws the 5-ball, he can score one point by pocketing the 5-ball. If the player draws the 9-ball, he can score two points by pocketing the 9-ball. Any balls which land on the table and do not go into a hole remain on the table and are in play. When a player legally pockets the 9-ball, all balls are returned to the bag. If a player accidentally tosses a ball into the "scratch hole" he loses his turn. The next player may then draw any ball and treat it like it is the lowest numbered ball.

In another mode of the method of play three players place the board on the ground and stand six feet away from the edge of the board. Players then choose the order of players by blindly choosing a ball playing in order from the player with the lowest numbered ball to the player with the highest numbered ball. All 15 balls are then placed on the ground. Each player selects a group of five balls (1-5, 6-10, 11-15). The first player, the one whose balls are numbered 1-5, then selects a ball from a grouping that is NOT one of his groups, meaning he can select any of the balls numbered 6-15) and attempts to pocket the selected ball in one of the six pockets. The player may only toss one ball per turn. The second player, the one whose balls are numbered 6-10, now selects a ball from a grouping that is not one of his, meaning he can select any of the balls numbered 1-5 or 11-15 balls, and attempts to pocket the selected ball in one of the six pockets. Again, the player may toss only one ball per turn.

Finally, the third player, the one whose balls are numbered 11-15, now selects a ball from a grouping that is not one of his, meaning you can select any ball numbered 1-10, and attempts to pocket it in one of the six pockets. Again, the player tosses only one ball per turn. Any balls which land on the table and do not go into a hole remain on the table and are in play. The rotation continues until only one player has at least one ball left and he is declared the winner. If a player tosses his ball into the "scratch hole," then each of the other opponents gets to remove one of his pocketed balls and add it to the pile on the ground. If an opponent does not have a pocketed ball, no further penalty occurs. If a player knocks his opponent's ball into the "scratch hole," the opponent adds his ball to the pile on the ground. The game ends when only one player has at least one of his balls left.

In another mode of the method of play, the game is played following the forgoing rules accept the game is played by five players and each player selects a group of three balls (1-3, 4-6, 7-9, 10-12, 13-15).

In another mode of the method of play two to six players place the board on the ground and stand six feet away from the edge of the board. Players then choose the order of players by blindly choosing a ball playing in order from the player with the lowest numbered ball to the player with the highest numbered ball. The number of balls to be pocketed varies, if playing with two players, the first person to get eight balls in his pocket is declared the winner, if playing with three players, the first person to get six balls in his pocket is declared the winner. If playing with four or five, players, the first person to get four balls in his pocket is declared the winner and if playing with six players, the first person to get three balls in his pocket.

Each player only tosses one ball per turn. The first person tosses a ball and if it goes into a pocket, that becomes "that player's pocket." If he misses, then all six pockets are still available. The next person now tosses his ball. If a pocket is "already taken" then he must toss his ball into one of the remaining five "open" pockets. If a ball is accidentally pocketed into another player's pocket, the ball stays in the pocket and is counted towards that players's total. Any balls which land on the table and do not go into a hole remain on the table and are in play. The rotation is continued until one person's pocket has the correct number of balls in it. If a player accidentally tosses a ball into the "scratch hole," he must remove one of his legally pocketed balls from his pocket.

If the player does not have a pocketed ball, no further penalty occurs. If a player knocks his opponent's ball into the "scratch hole", the opponent reclaims his ball and tosses the ball again. If a player already has an established pocket, and pockets his ball in a pocket other than his own or his opponent's, that ball is returned to the player and his turn is over. The game ends when one player's designated hole has the correct number of balls in it.

In another mode of the method of play two or more players place the board on the ground and stand six feet away from the edge of the board. Players then choose the order of players by blindly choosing a ball playing in order from the player with the lowest numbered ball to the player with the highest numbered ball. The first player to play tosses any of the fifteen balls. If he successfully pockets a ball, he continues to shoot balls until he misses. If he makes all fifteen balls in a row, that is known as "running the table." Players note all the points he scored on his turn known as his "run."

The next player now gets to select any of the fifteen balls. Any balls which land on the table and do not go into a hole remain on the table and are in play. If a player pockets a ball in the "scratch hole," he loses his turn and gets penalized five points. If he does not have five points, his total scored goes into the negatives.

The game ends when a player reaches the designated number of points. The designated points per game varies based on the number of players. If playing with two players, the game end when a player reaches 50 points. If playing with three players, the game ends with a player reaches 40 points. If playing with four or more players, the game ends when a player reaches thirty points.

In another mode of the method of play two players place the board on the ground and stand six feet away from the edge of the board. Players then choose the order of players by blindly choosing a ball playing in order from the player with the lowest numbered ball to the player with the highest numbered ball. The first player selects either solids or stripes. The 8-ball is not used in this game. The first player tosses a ball into any of the six pockets.

If he is successful, he continues to shoot until he misses or pockets a second ball in a pocket. If a second ball goes into a pocket, the ball is removed and the player loses his turn. The next player then tosses a ball into any of the six pockets. If he is successful, he continues to shoot until he misses or pockets a second ball in a pocket. If a second ball goes into a pocket, the ball is removed and the player loses his turn. Any balls which land on the table and do not go into a hole remain on the table and are in play.

If a player accidentally tosses a ball into the "scratch hole," he must remove one of his legally pocketed balls from one of the pockets. If he does not have a legally pocketed ball, no further penalty occurs. If a player knocks his opponent's ball into the "scratch hole," the opponent reclaims his ball and tosses the ball again. The game ends when one player gets a ball in every pocket.

In another mode of the method of play, the game is played following the forgoing rules except the pockets are numbered one to six starting with the lower left corner and going clockwise around the table. The player tossing the ball must pocket the balls in holes one through six in number order from lowest to highest. If the ball is pocketed in a pocket out of order, the player loses his turn, the ball is removed, and the ball does not count.

In another mode of the method of play two to five players place the board on the ground and stand six feet away from the edge of the board. Players then choose the order of players by blindly choosing a ball playing in order from the player with the lowest numbered ball to the player with the highest numbered ball. The two lowest corner pockets are each worth one point.

For scoring purposes, the two middle side pockets are each worth two points and the two upper corner pockets are each worth three points. Each player receives three balls. Based on the order of play determined, players toss each of their balls one at a time trying to score points in one of the six holes.

If the player tosses all three of his balls, it is the next player's turn. Each players turn is referred to as an "inning." Play rotates through players until all players have tossed. Players then count the number of points scored by each player during his inning. During a player's inning, any balls which land on the table and do not go into a hole remain on the table and are in play.

After a player's inning is over, all three of his balls are to be picked up and are no longer in play. If a player goes over 21 points, his inning is ended and he goes back to the amount of points he had at the start of his inning. If a player scratches, his inning is over, and he receives no points for any scores from that inning.

The first player who scores exactly 21 points during his inning is declared the winner. If the other players have not had the same amount of innings and can reach 21 points, they have an opportunity to force an overtime tie. In overtime, each player tosses his three balls and the one with the highest score in the inning is declared the winner.

Figure 9:
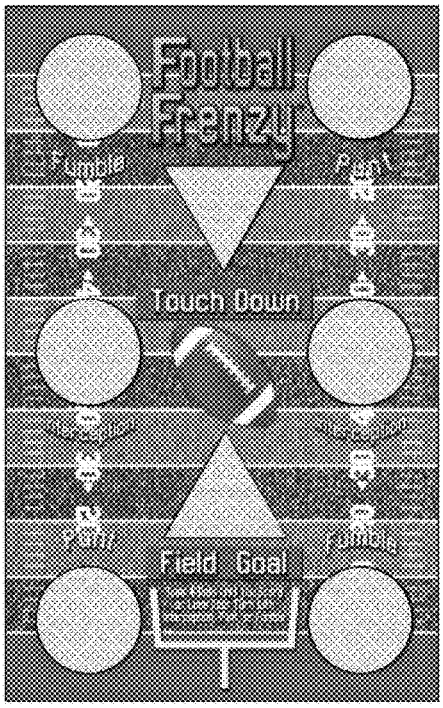

FIG. 9 depicts one possible configuration of a board slat with aperture positions and configurations suitable for use with the following modes of the method of play:

In another mode of the method of play two or more players place the board on the ground and stand six feet away from the edge of the board. Players determine how long they would like the game to last either by designating a number of minutes or a number of turns of play. Players then choose the order of players by blindly choosing a ball playing in order from the player with the lowest numbered ball to the player with the highest numbered ball.

In this mode, each player uses four balls. Based on the order of play determined, players toss their balls one at time attempting to score a touchdown or a field goal. If the player misses the board or fails to land in any hole, that player loses one "down." After four "downs," the player's turn is over. If the player tosses a ball and it lands in one of the scoring triangles, the player scores and the player's turn is now over.

Scoring in this mode, the player scores three points for a Field Goal, and seven points for Touchdown. A player loses his turn if goes "Four and Out" by losing four consecutive downs, lands land in the Fumble Circle, lands in the Interception Circle, or lands in the Punt Circle. The game ends when the designated time expires or the designated number of "innings" are played. The player who has scored the most point wins.

Figure 10:
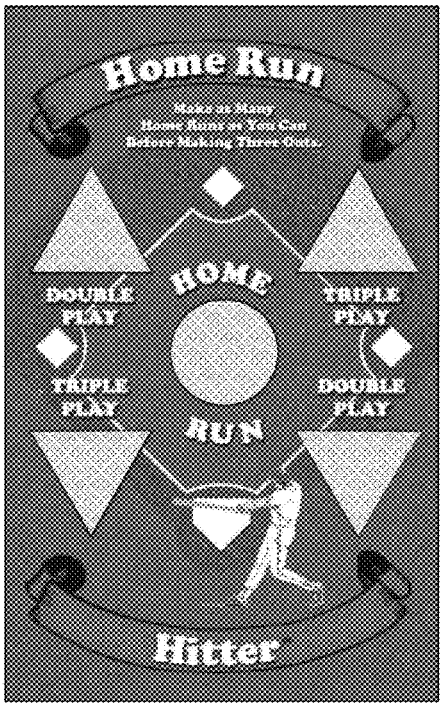

FIG. 10 depicts one possible configuration of a board slat with aperture positions and configurations suitable for use with the following modes of the method of play:

In another mode of the method of play, two or more players place the board on the ground and stand six feet away from the board. Players then choose the order of players by blindly choosing a ball playing in order from the player with the lowest numbered ball to the player with the highest numbered ball.

Each player uses all of the available balls. Based on the order of play determined, players toss their balls one at time attempting to pocket the ball in the home run hole. If the player fails to toss the ball in any hole, the player is awarded an out. When a player gets three outs, his inning is over. If the player tosses the ball into one of the Double Play Triangles he gets two outs. If the player tosses the ball into one of the Triple Play Triangles, he gets three outs and his turn is over. Once the player get three outs, the player counts and notes his number of home runs. Players keep score for nine turns called "innings." If the player fails to toss the ball in any hole, he is awarded an out. When a player gets three outs, his inning is over. If the player tosses the ball into one of the four triangles, that is a triple play and his inning ends immediately. The game ends when all players have played 9 innings. The player with the most home runs after nine innings is declared the winner.

Figure 11:
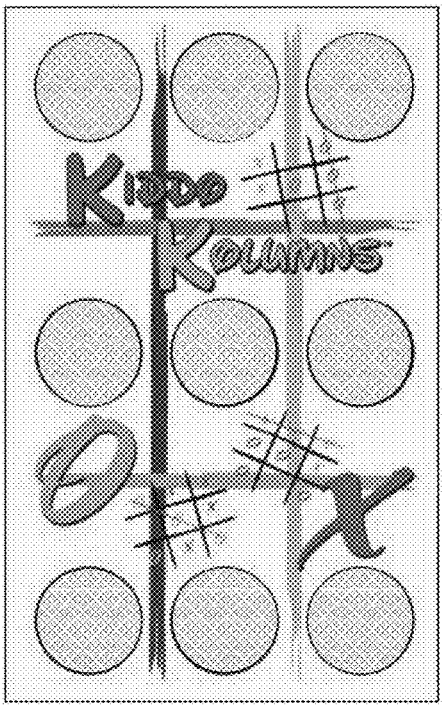

FIG. 11 depicts one possible configuration of a board slat with aperture positions and configurations suitable for use with the following modes of the method of play:

In another mode of the method of play two players place the board on the ground and stand six feet away from the edge of the board. Players then choose the order of players by blindly choosing a ball playing in order from the player with the lowest numbered ball to the player with the highest numbered ball. Each player receives five balls and is attempting to build a column either horizontally, vertically, or diagonally on the game slat. Each player only tosses one ball per inning.

After a player's toss, his turn is over. If the player pockets a ball, that hole is now closed and no player may pocket his ball that pocket. Players alternate turns throwing one ball at a time. After each player's turn, any ball remaining on the table is cleared and returned to the thrower. Players repeat turns until the game ends. If a player loses a turn if he does not pocket the ball in an "open" hole, pockets a ball in a "closed" hole, that ball does not count and is removed, or fails to pocket his ball in any hole. The first player to pocket his ball in three holes horizontally, vertically, or diagonally wins. Alternatively, players may toss until the player pockets a ball in a hole, or all holes are open so first pocket to connect three wins.

Figure 12:
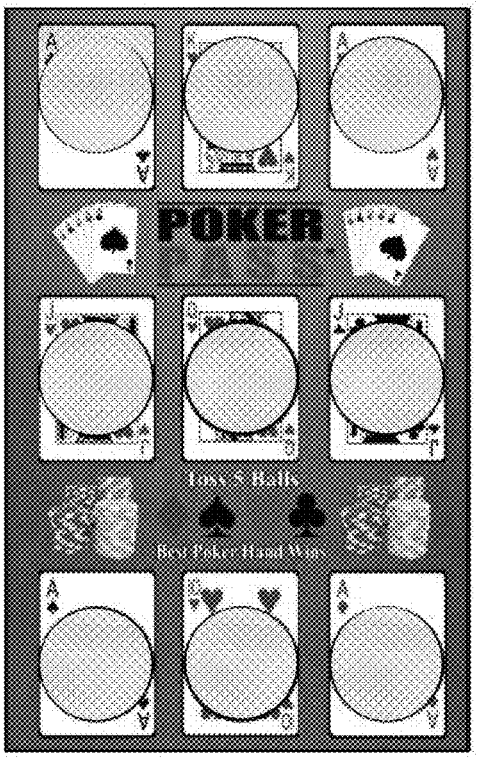

FIG. 12 depicts one possible configuration of a board slat with aperture positions and configurations suitable for use with the following modes of the method of play:

In this mode of the method of play two or three players place the board on the ground and stand six feet away from the edge of the board. Players then choose the order of players by blindly choosing a ball playing in order from the player with the lowest numbered ball to the player with the highest numbered ball. Each player receives five balls. Based on the order of play determined, players receive five balls and toss one ball at a time trying to pocket their ball in one of the nine holes. If the player gets a ball in a pocket, then the corresponding playing card for that pocket goes into the player's hand.

During this mode of play, the pocket remains "open" so multiple players may have balls in the same pocket. If the player does not make a ball in a pocket, the player continues to shoot until a ball is pocketed. If the player pockets a ball in a pocket that is already occupied by one another player's balls, the second ball does not count.

The player continues to shoot until he legally pockets a ball. The player's turn end when he legally pocket a ball, thus adding a card to his hand. A ball is considered legally pocketed when it is pocketed into a hole that the player does not currently have a ball in. Multiple players may have their balls in the same hole. When all players have five cards in their hand, the game ends.

The person with the highest scoring hand wins the game. The hierarch of possible poker hands for the game is Royal Flush, Five of a Kind, Four of a Kind, Full House, Flush, Straight, Three of a Kind, Two Pairs, One Pair, High Card.

Alternatively, each toss counts and if a player misses he is given a miscellaneous card that cannot help his hand.

Figure 13:
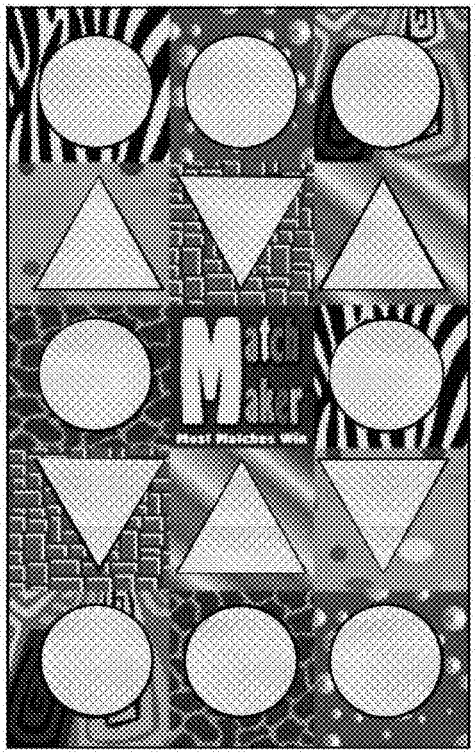

FIG. 13 depicts one possible configuration of a board slat with aperture positions and configurations suitable for use with the following modes of the method of play:

In another mode of the method of play two or more players place the board on the ground and stand six feet away from the edge of the board. Players then choose the order of players by blindly choosing a ball playing in order from the player with the lowest numbered ball to the player with the highest numbered ball. The balls are divided equally amongst the players.

Based on the order of play determined, each player tosses his first ball trying to pocket his ball in one of the fourteen holes. If the player pockets his first ball, he then tosses a second ball into the matching pocket. If the player successfully pockets both balls, that match goes to that player. That pocket becomes "closed" and no other player may pocket a ball in it.

The player continues to shoot until he fails to make a match, If the player misses the second ball, neither ball counts. Both pockets remain "open" and the player gets both balls back and his turn is now over. If the player does not make his first ball, the player gets his ball back and his turn is now over. If the player pockets his ball in a pocket that is "closed", that ball does not count, the player gets his ball back and his turn is over.

Players maintain the rotation until the game ends. After each player's turn, any ball remaining on the table is cleared and returned to the thrower. The players loses his turn if he does not pocket his first ball in an "open" hole, does not pocket his second ball in the matching hole of his first, or pockets either ball in a hole that is "closed." The game ends with a player makes the majority matches and that player is declared the winner.

Figure 14:
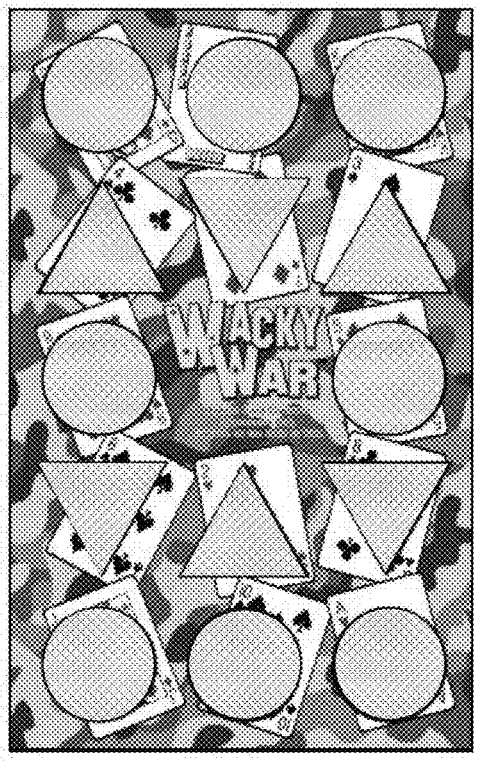

FIG. 14 depicts one possible configuration of a board slat with aperture positions and configurations suitable for use with the following modes of the method of play:

In this mode of the method of play two to five players place the board on the ground and stand six feet away from the edge of the board. Players then choose the order of players by blindly choosing a ball playing in order from the player with the lowest numbered ball to the player with the highest numbered ball.

The balls are divided equally amongst the players. Based on the order of play determined, each player tosses his ball trying to pocket his ball in one of the fourteen holes. If the player pockets his ball, the value of the card is give to the player. If you the player misses a pocket, he receives no score for his throw.

Whichever player scores the highest card in turn, or "inning," receives the other players' tossed balls. If two or more players tie for the highest card, a war is declared between those two players. Those two players toss another ball and the player that scores the highest receives all of the other player's tossed balls, including the ball(s) which started the war. Players maintain the rotation until the game ends. The cards are ranked in value 2, 3, 4, 5, 6, 7, 8, 9, 10, J, Q, K, A. The Jokers are wild card and can be made any value the player wants. This means if a player has a Joker, he can declare war at any time. The first player to take all of the opponent's balls wins.

Figure 15:
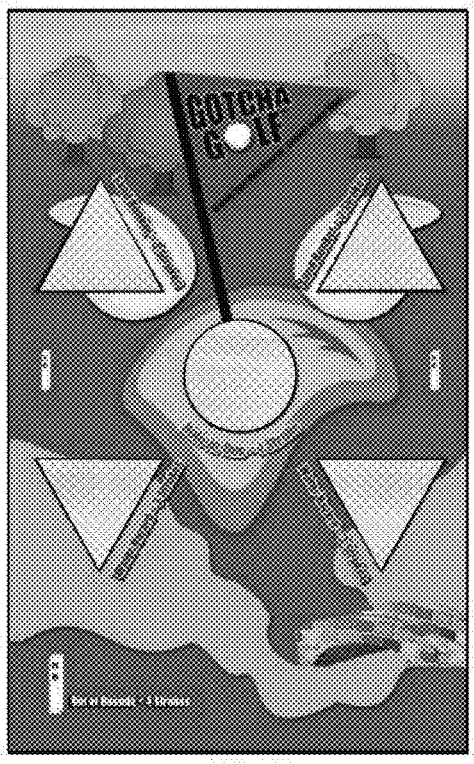

FIG. 15 depicts one possible configuration of a board slat with aperture positions and configurations suitable for use with the following modes of the method of play:

In another mode of the method of play, one to 15 players place the board on the ground and draw a 10 foot circle around the board. Players then choose the order of players by blindly choosing a ball playing in order from the player with the lowest numbered ball to the player with the highest numbered ball.

In this mode of play, players alternate turns "making the hole" by selecting the slant of the board and the location from where players will throw. The players' object is to score the lowest out of 18 holes. The player tosses his ball trying to pocket the ball in the circular hole. After his turn, the player's ball is picked up and is now out of play.

After each player has a turn, each player notes his individual score on a piece of paper. After each hole ends, the player with the next lowest ball goes first so the order rotates. The player that goes first determines where everyone stands for that hole, players may stand anywhere within a 10 foot circle of the playing surface and determines the slope of the playing surface by adjusting the height of the legs the device.

Also in this mode of play, players earn 1 point for a "Hole-in-One," the player's ball goes in the circular hole, two points for a "Birdie," the player's ball remains on the table, three points for a "Par," the player's ball goes into the triangular bunker hazard, four points for a "Bogey," player's ball goes into the triangular water hazard, and five points for a "Double Bogey," the player's ball goes off the table which is considered "Out of Bounds." After all 18 holes have been played, the player with the lowest score wins.

In another mode of the method of play, the game is played following the forgoing rules except the game is played by two players and after each player has gone, the person with the lowest score wins the hole. If both players tie, the hole is a "push" and no points are scored. The first player to win 10 holes wins the match.

Figure 16:
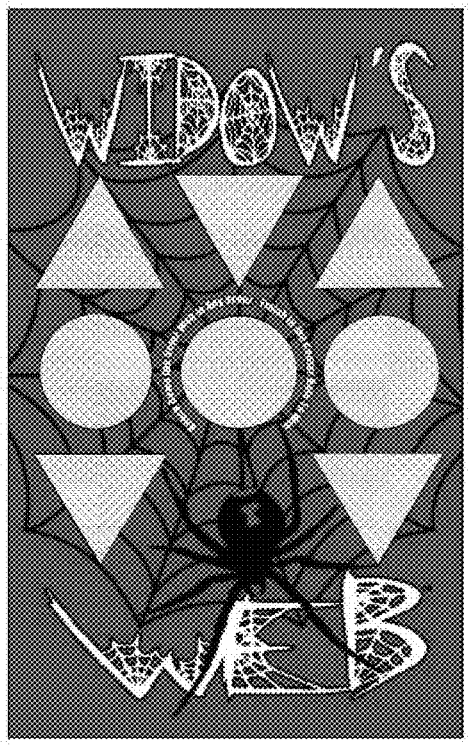

FIG. 16 depicts one possible configuration of a board slat with aperture positions and configurations suitable for use with the following modes of the method of play:

Using this slat in a mode of the method of play two players place the board on the ground and stand six feet away from the edge of the board. Players then choose the order of players by blindly choosing a ball playing in order from the player with the lowest numbered ball to the player with the highest numbered ball. Each player receives seven solid or seven striped balls. Based on the order of play determined, players toss their balls one at time attempting to pocket the ball in one of the outside web holes.

During play of this mode, if the player pockets a ball in any one of the outside web holes, he goes again. Once the player has pocketed a ball in each of the web holes, the player tosses the Black Widow's Ball and it must go into the Black Widow's Hole. The player loses a turn if the player does not pocket a ball, pockets a ball in a "web hole" that is already occupied by his own ball, or if a player pockets a ball in the Black Widow's Hole, in which case, he must also remove one of his legally pocketed balls. If the player does not have any legally pocketed balls, there is no additional penalty. The game ends when a player has legally pocketed all of his balls in each of the seven web holes in any order and then pockets the Black Widow's Ball in the Black Widow's Hole.

Figure 17:
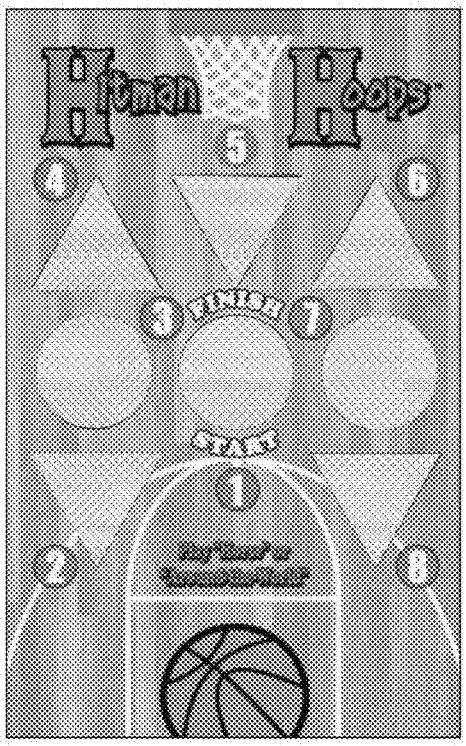

FIG. 17 depicts one possible configuration of a board slat with aperture positions and configurations suitable for use with the following modes of the method of play:

In another mode of the method of play two or more players place the board on the ground and stand six feet away from the edge of the board. Players then choose the order of players by blindly choosing a ball playing in order from the player with the lowest numbered ball to the player with the highest numbered ball.

During play in this mode, each player uses two balls. Based on the order of play determined, players toss their balls one at time attempting to pocket the ball in the first hoop/basket. If the player makes the basket, he leaves that ball in the hole and moves onto the next hoop/basket in a clockwise direction. If he makes the next one, he picks up his first and leaves his second one in so the player always know where he is at in the order play of the hoops/baskets. Once per game a player may call "Chance" or "Prove It." If the player misses the basket, he may call "Chance". He then gets a second opportunity to make the basket. If he makes it, he continues to the next hoop. If he fails to make his second attempt, he goes back to the beginning. At any time, an opponent may call "Prove it." The person that just made a shot must shoot the same shot again. If the person makes the shot, the person who called "prove it" must go back to the beginning. If the person misses the shot, he cannot move ahead to the next hoop and his turn is over. The game ends when a player makes all the baskets in consecutive order.

In another mode of the method of play two or more players place the board on the ground and stand six feet away from the edge of the board. Players then choose the order of players by blindly choosing a ball playing in order from the player with the lowest numbered ball to the player with the highest numbered ball. Each player uses two balls. Based on the order of play determined, players toss their balls one at time. The player can toss the ball from anywhere he wants to and must name his pocket. If the player makes the basket, the opponent must make the same shot or he will be given a letter of the word H-O-R-S-E. If the player misses the basket, it is the other person's turn. The first person to get all 5 letters in the word H-O-R-S-E loses the game.

Figure 18:
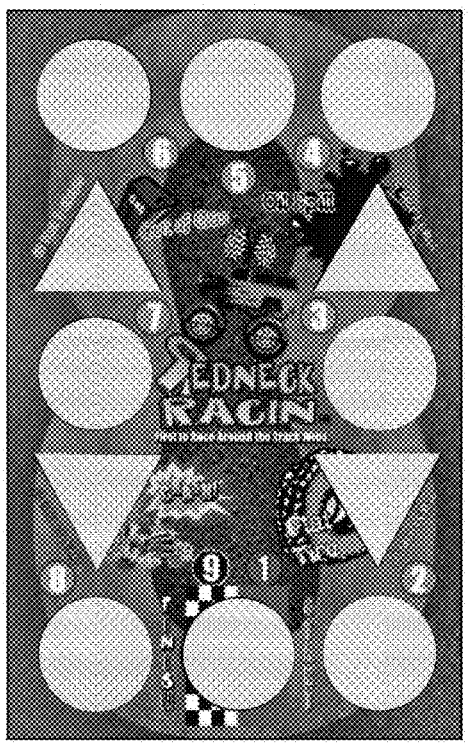

FIG. 18 depicts one possible configuration of a board slat with aperture positions and configurations suitable for use with the following modes of the method of play:

In another mode of the method of play two or more players place the board on the ground and stand six feet away from the edge of the board. Players then choose the order of players by blindly choosing a ball playing in order from the player with the lowest numbered ball to the player with the highest numbered ball. Each player uses two balls of the same color (one solid and one striped). Based on the order of play determined, players toss their balls one at time attempting to get the pall in the designated circles and not the triangles. If the player pockets his ball in a circle, he keeps his ball in that circle. For his next turn, he uses his second ball. If he successfully pockets that ball, he keeps that ball in the new circle and takes back his first ball for his next turn. If the player does not pocket his ball, he loses his turn and takes his ball back. Each player only gets one toss per turn. If the player pockets his ball in a triangle, follow the designated penalty. Each of the triangles has a trouble associated with it. If the player's ball lands on the Oil Spill triangle, he goes back one space, the Flat Tire Triangle, he goes back two spaces, the Out of Gas triangle he goes back three spaces, and the crash triangle he goes back to the beginning and starts again. The first person to get his car around the track wins and the game ends.

Figure 19:
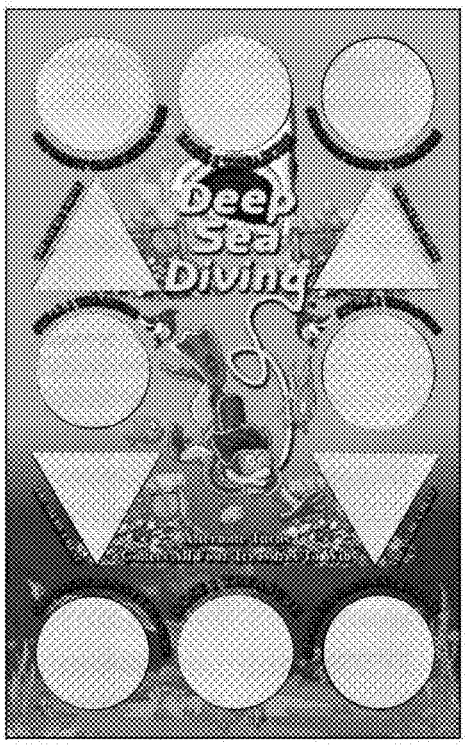

FIG. 19 depicts one possible configuration of a board slat with aperture positions and configurations suitable for use with the following modes of the method of play:

In another mode of the method of play two or more players place the board on the ground and stand six feet away from the edge of the board. Players then choose the order of players by blindly choosing a ball playing in order from the player with the lowest numbered ball to the player with the highest numbered ball. Each player uses four balls. Based on the order of play determined, players toss their balls one at time attempting to get the ball in one of the four triangle treasure holes not in the black holes. If the player pockets his ball in a triangle, he keeps his ball in that triangle. If the player pockets his ball in a black hole, he must take a ball out of a triangle treasure. If the player does not pocket his ball, he loses his turn and takes his ball back. Each player only gets one toss per turn. The first person to get a ball in each of the four triangle treasures wins. Each of the black holes has a trouble associated with it. If the player's ball goes into the black hole, the player follows the penalty specified for that black hole, If the player has no treasures, there is no further penalty. The game ends when one player collects all four treasures.

Figure 20:
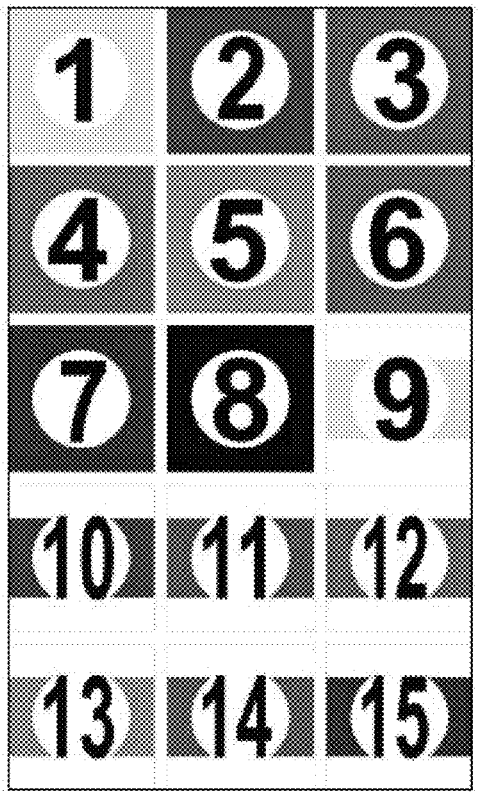

FIG. 20 depicts one possible configuration of a board slat with aperture positions and configurations suitable for use with the following modes of the method of play:

In another mode of the method of play two or more players place the board on the ground and stand six feet away from the edge of the board. Players then choose the order of players by blindly choosing a ball playing in order from the player with the lowest numbered ball to the player with the highest numbered ball. Each player uses 15 balls. Based on the order of play determined, players toss each of their balls one at a time trying to score points in one of the six holes. The player tosses all 15 balls one at a time until he misses or gets two balls in the same hole A player's turn is over when he tosses a ball and he misses or he gets a second ball in the same hole. After each player has tossed, the player with the most amount of filled cubes wins.

In another mode of the method of play two to five players place the board on the ground and stand six feet away from the edge of the board. Players then choose the order of players by blindly choosing a ball playing in order from the player with the lowest numbered ball to the player with the highest numbered ball. Each player receives the corresponding number of balls determined by the number of players. If there are two players, players receive seven balls each and the cube insert for whichever ball is not selected is flipped to black. If there are three, each player receives five balls and all cube inserts display their numbered side. If there are four players, each player received three balls the cube inserts for whichever balls are not selected are flipped to black. If there are five players, each player received five balls and all cube inserts should display their numbered side. It is recommended players mix the numbered inserts and place randomly in the game box. Based on the order of play determined, players toss each of their balls one at a time trying to toss the ball into one of their designated cubes. The player's turned ends when the player misses, tosses a ball into the wrong numbered cube, or tosses a ball into a black cube. If a player tosses one of his balls into one of the black cubes, he must remove one of his pocketed balls. If no balls are pocketed, the player receives no further penalty. The game ends when a player successfully tosses all of his balls into the designated cubes.

In another mode of the method of play two or more players place the board on the ground and stand six feet away from the edge of the board. Players then choose the order of players by blindly choosing a ball playing in order from the player with the lowest numbered ball to the player with the highest numbered ball. It is recommended players randomly flip over the inserts to display the numbered sides, not the black sides. Each player receives five balls. Based on the order of play determined, players toss each of their balls one at a time trying to score points in the numbered cubes.

The player tosses all five of his and then is turn or "inning" is over. Player's count and note the number of points scored by each player during his inning. Rotate players in the order selected. If a player goes over 225 points, his inning is ended and he goes back to the amount of points he started his inning. The first player who tosses exactly 225 points during his inning is declared the winner. If the other players have not had the same amount of innings and can reach 225 points, they have an opportunity to force an overtime tie. In overtime, each player tosses his five balls and the one with the highest score in the inning is declared the winner.

In another mode of the method of play, the game is played following the forgoing rules except the players randomly place the #1, #2, and #3 Magic Squares in the game device as indicated. All other squares are black. Each player tosses 3 balls and you are attempting to score exactly 21 points. If the player's ball lands in one of the numbered squares, he earns the specified points. If the player lands in a black square, there is no penalty except that toss does not score any points. If in an inning the player scores more than 21 points, he receives no points for that inning and you lose your turn. Game ends when a player scores exactly 21 points. Alternatively, players make can make the black squares a penalty and no points are scored.

In another mode of the method of play two or more players place the board on the ground and stand six feet away from the edge of the board. Players then choose the order of players by blindly choosing a ball playing in order from the player with the lowest numbered ball to the player with the highest numbered ball. It is recommend players randomly flip over the inserts to display the numbered sides, not the black sides. Each player receives one ball. Based on the order of play determined, players take turns throwing their balls. The player must call a cube and then toss his ball into the selected cube. If the player misses, his turn is over and the next player calls a cube. If the player gets his ball in the cute the player called, he leaves his ball in his and the other have two options. He can shoot for the previous player's cube. If he makes it, neither player scores a point. If he misses it, the player who made it scores a point. Alternatively, the player an shoot for another cube. If he makes it, both players score a point. If he misses it, the player who made it scores a point. When playing with 3 or more players, each subsequent player has the choice of tossing for an empty cube or tossing for an occupied cube. If the player does not toss the ball into the cube he called, his turn is over.

In another mode of the method of play two to five players place the board on the ground and stand six feet away from the edge of the board. Players then choose the order of players by blindly choosing a ball playing in order from the player with the lowest numbered ball to the player with the highest numbered ball. Depending upon the number of players the cubes are arranged as follows:

| Players | Cube Inserts |
|---|---|
| 2 Players | Left Column Solids, Center Column all Black, Right Column Stripes |
| 3 Players | Left Column 1-5, Center Column 6-10, Right Column 11-15 |
| 4 Players | Turn board 90 degrees. 1st Column 1-3, 2nd Column 4-6, 3rd Column Black, 4th Column 10-12, 5th Column 13-15 |
| 5 Players | Turn board 90 degrees. 1st Column 1-3, 2nd Column 4-6, 3rd Column 7-9, 4th Column 10-12, 5th Column 13-15 |

If there are two or three players, each player receives five balls. If there are four or five players, each player receives three balls. Based on the order of play determined, the player tosses a ball into his column. After each toss, the player's turn is over. If player gets his ball in an empty cube in his column, the ball stays in the magic square. If the player make it in an opponent's column, he retrieves the ball. If the player misses the table completely, he retrieves the ball. If the player tosses his ball into one of the black squares, he retrieves his ball and incurs a penalty. Each player tosses one ball per turn. If a player tosses one of his balls into one of the black cubes, he must remove one of his pocketed balls. If no balls are pocketed, the player receives no further penalty. The first player to fill his vertical columns and complete his Totem Pole wins.

In another mode of the method of play two to five players place the board on the ground, place the Number 1 Magic Square in the 3rd Row and 3rd Column, the Number 2 Magic Square in the 5th Row and 3rd Column, and the Number 3 Magic Square in the 1st Row and 3rd Column, and stand six feet away from the edge of the board. Players then choose the order of players by blindly choosing a ball playing in order from the player with the lowest numbered ball to the player with the highest numbered ball. Each player receives three balls. In the order determined, players toss each of their balls one at a time trying to score points in any of the three identified squares. Players are awarded the point value of the square. After the player tosses all three of his balls, it is the next player's turn. Rotate until all players have tossed. Count the number of points scored by each player during his inning. If a player goes over 21 points, his inning is ended and he goes back to the amount of points he started his inning. Any balls tossed into the black squares score no points. The first player who scores exactly 21 points during his inning is declared the winner. If the other players have not had the same amount of innings and can reach 21 points, they have an opportunity to force an overtime tie. In overtime, each player tosses his three balls and the one with the highest score in the inning is declared the winner.

In another mode of the method of play two or more players place the board on the ground, shuffle up the squares blindly without looking at the values and place the squares with the black side showing and stand 6 feet away from the edge of the board. Each player receives two balls. Players then choose the order of players by blindly choosing a ball playing in order from the player with the lowest numbered ball to the player with the highest numbered ball. Each player receives two balls. In the order determined, players Toss their balls one at a time, and turn over the black square of the ball lands in to reveal the hole value. The player then tosses his second ball trying to toss the ball into the "Sister Square" (hole) that is the square that has the same colored ball—one striped and one solid. The player loses his turn if his ball lands in the 8-ball square, he does not get a ball in a square or if the player does not make a match. The winner is the first player to make a majority of the matches.

In another mode of the method of play two or more players place the board on the ground with the magic squares turned to black and Stand 6 feet away from the edge of the board. It is recommended players shuffle up the squares blindly without looking at the values and then put the squares in the cubes with the black side showing. Players then choose the order of players by blindly choosing a ball playing in order from the player with the lowest numbered ball to the player with the highest numbered ball. Each player receives one ball. In the order determined, the player tosses his ball and turns over the square to reveal the value/score of the square. The next player then tosses a ball and turns over the square to reveal his score. If a player lands in the same square as the previous player, no points are rewarded. If the player lands in different squares, the highest score wins a point. Once all players have tossed, remove the square landed in from play. If the player lands in a box with no square the player scores no points. The player loses his turn if the player miss getting the ball in a square or his ball lands in a square that has no value. Players play until a player reaches 10 points. Alternatively, players may toss 3 or more balls and total cumulative score wins that turn or "inning." If the player land in the same box, both score the point or the player can negate that point for both players.

In another mode of the method of play two or more players place the board on the ground and stand 6 feet away from the edge of the board. It is recommend player place in the middle vertical column of the device squares 1-5 from top to bottom. Players then choose the order of players by blindly choosing a ball playing in order from the player with the lowest numbered ball to the player with the highest numbered ball. Each player receives five balls. In the order of play determined, the players toss their balls one at a time trying to get one ball in each row. If the player tosses a second ball into the same row, he gets the ball back and his turn is over. The first player to get one ball in each row wins and the game ends.

Each of the aforementioned modes of the method of play may be varied by requiring players to bank shots by bouncing the ball off a wall or other item before the ball may land on the device.

As noted, any of the different configurations and components can be employed with any other configuration or component shown and described herein. Additionally, while the present invention has been described herein with reference to particular embodiments thereof and steps in the method of production, a latitude of modifications, various changes and substitutions are intended in the foregoing disclosures, it will be appreciated that in some instance some features, or configurations, or steps in formation of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A multi-configurable tossing game apparatus, comprising:

a rectangular body having a top surface and a bottom surface;

a plurality of bins depending into said top surface of said body;

a support frame, said support frame having an upper surface and a lower surface;

a removable engagement connecting said support frame to said bottom surface of said body thereby positioning said support frame in an engaged position;

legs in an engagement with said lower surface of said support frame, said legs supporting said body and said support frame in an elevated position above a support surface, with said support frame in said engaged position;

a plurality of bean bags;

a plurality of game slats, each of said plurality of game slats having a plurality of slat apertures communicating therethrough;

each said game slat positionable to a playing position in a removable engagement upon said top surface of said body wherein the game slat forms a cover over all of the plurality of bins depending into said top surface;

each said game slat in said playing position positioning a respective said plurality of slat apertures in respective aligned positions with underlying bins depending into said top surface;

a storage cavity formed between said bottom surface of said body and said upper surface of said support frame with said support frame in said engaged position; said storage cavity having sides for holding said plurality of game slats therein;

indicia positioned on a upper surface of each said game slat, said indicia viewable by players with each respective said game slat in said laying position;

said indicia on each respective said game slat in said plurality of game slats positioned to a said game playing position, determining a different respective game from a plurality of games equal to said plurality of game slats, which are playable by said players, by a tossing of said bean bags through said slat apertures of a chosen said game slat from said plurality game slats which is engaged to said playing position; and whereby users may removably engage any of said plurality of game slats to said playing position and thereby choose a respective said game to play, from said plurality of games and;

a transit slat, said transit slat positionable to said playing position in said removable engagement upon said top surface of said body; said transit slat being a solid surface and defining a table top surface when positioned to said game playing position.

2. The multi-configurable tossing game apparatus of claim 1 wherein a number of a respective said plurality of slat apertures communicating through at least one of said plurality of game slats, is less than a number of said plurality of bins.

3. The multi-configurable tossing game apparatus of claim 1 additionally comprising:

said engagement of each of said legs with said lower surface of said support frame being a pivotal engagement of a first end of said legs adjacent said lower surface of said support frame;

said legs pivotable from a supporting position, supporting said body and said support frame in an elevated position, to a stored position wherein each of said legs folds against said lower surface of said support frame; and wheels positioned on one end of said support frame, wherein said body with said support frame removably engaged, is rollable upon said wheels.

4. The multi-configurable tossing game apparatus of claim 1, additionally comprising:

light emitters configured for positioning in at least one of said plurality of bins.

5. The multi-configurable tossing game apparatus of claim 1 additionally comprising:

an opening communicating through a sidewall of said support frame with said storage cavity; and said opening allowing for said game slats to be inserted and removed from said storage cavity.

6. A multi-configurable tossing game apparatus, comprising:

a rectangular body having a top surface and a bottom surface;

a plurality of bins depending into said top surface of said body;

a plurality of bean bags;

a plurality of game slats, each of said plurality of game slats having a plurality of slat apertures communicating therethrough;

a number of a respective said plurality of slat apertures communicating through at least one of said plurality of game slats, is less than a number of said plurality of bins;

each said game slat positionable to a playing position in a removable engagement upon said top surface of said body wherein the game slat forms a cover over all of the plurality of bins depending into said top surface;

each said game slat in said playing position positioning a respective said plurality of slat apertures in respective aligned positions with underlying bins depending into said top surface;

indicia positioned on an upper surface of each said game slat, said indicia viewable by players with each respective said game slat in said playing position;

said indicia on each respective said game slat in said plurality of game slats positioned to a said game playing position, determining a different respective game from a plurality of games equal to said plurality of game slats, which are playable by said players, by a tossing of said bean bags through said slat apertures of a chosen said game slat from said plurality game slats which is engaged to said playing position;

a support frame, said support frame having an upper surface and a lower surface;

a removable engagement connecting said support frame to said bottom surface of said body thereby positioning said support frame in an engaged position;

legs in an engagement with said lower surface of said support frame, said legs supporting said body and said support frame in an elevated position above a support surface, with said support frame in said engaged position;

a storage cavity formed between said bottom surface of said body and said upper surface of said support frame with said support frame in said engaged position;

said storage cavity having sides for holding said plurality of game slats therein;

whereby users may removably engage any of said plurality of game slats to said playing position and thereby choose a respective said game to play, from said plurality of games.

7. The multi-configurable tossing game apparatus of claim 6, additionally comprising:

said engagement of each of said legs with said lower surface of said support frame being a pivotal engagement of a first end of said legs adjacent said lower surface of said support frame;

said legs pivotable from a supporting position supporting said body and said support frame in an elevated position, to a stored position wherein each of said legs folds against said lower surface of said support frame; and wheels positioned on one end of said support frame, wherein said body with said support frame removably engaged, is rollable upon said wheels.

8. A multi-configurable tossing game apparatus, comprising:

a rectangular body having a top surface and a bottom surface;

a plurality of bins depending into said top surface of said body;

a plurality of bean bags;

a plurality of game slats, each of said plurality of game slats having a plurality of slat apertures communicating therethrough;

a number of a respective said plurality of slat apertures communicating through at least one of said plurality of game slats, is less than a number of said plurality of bins;

each said game slat positionable to a playing position in a removable engagement upon said top surface of said body wherein the game slat forms a cover over all of the plurality of bins depending into said top surface;

each said game slat in said playing position positioning a respective said plurality of slat apertures in respective aligned positions with underlying bins depending into said top surface;

indicia positioned on a upper surface of each said game slat, said indicia viewable by players with each respective said game slat in said laying position;

said indicia on each respective said game slat in said plurality of game slats positioned to a said game playing position, determining a different respective game from a plurality of games equal to said plurality of game slats, which are playable by said players, by a tossing of said bean bags through said slat apertures of a chosen said game slat from said plurality game slats which is engaged to said playing position;

a transit slat, said transit slat positionable to said playing position in said removable engagement upon said top surface of said body;

said transit slat being a solid surface and defining a table top surface when positioned to said game playing position;

a support frame, said support frame having an upper surface and a lower surface;

a removable engagement connecting said support frame to said bottom surface of said body thereby positioning said support frame in an engaged position;

legs in an engagement with said lower surface of said support frame, said legs supporting said body and said support frame in an elevated position above a support surface, with said support frame in said engaged position;

a storage cavity formed between said bottom surface of said body and said upper surface of said support frame with said support frame in said engaged position;

said storage cavity having sides for holding said plurality of game slats therein; and whereby users may removably engage any of said plurality of game slats to said playing position and thereby choose a respective said game to play, from said plurality of games.

9. The multi-configurable tossing game apparatus of claim 8, additionally comprising:

said engagement of each of said legs with said lower surface of said support frame being a pivotal engagement of a first end of said legs adjacent said lower surface of said support frame;

said legs pivotable from a supporting position supporting said body and said support frame in an elevated position, to a stored position wherein each of said legs folds against said lower surface of said support frame; and wheels positioned on one end of said support frame, wherein said body with said support frame removably engaged, is rollable upon said wheels.

10. The multi-configurable tossing game apparatus of claim 8 additionally comprising:

a shape of some of at least one of said plurality of slat apertures communicating through a respective game slat, being different than a shape of said bins depending into said top surface of said body.

11. The multi-configurable tossing game apparatus of claim 9 additionally comprising:

a shape of some of at least one of said plurality of slat apertures communicating through a respective game slat, being different than a shape of said bins depending into said top surface of said body.

12. The multi-configurable tossing game apparatus of claim 8 additionally comprising:

light emitters configured for positioning in at least one of said plurality of bins.

13. The multi-configurable tossing game apparatus of claim 10, additionally comprising:

light emitters configured for positioning in at least one of said plurality of bins.

14. The multi-configurable tossing game apparatus of claim 11, additionally comprising:

light emitters configured for positioning in at least one of said plurality of bins.

15. The multi-configurable tossing game apparatus of claim 8 additionally comprising:

an opening communicating through a sidewall of said support frame with said storage cavity; and said opening allowing for said game slats to be inserted and removed from said storage cavity.

16. The multi-configurable tossing game apparatus of claim 9 additionally comprising:

an opening communicating through a sidewall of said support frame with said storage cavity; and said opening allowing for said game slats to be inserted and removed from said storage cavity.

* * * * *